US011262671B2

(12) United States Patent
Fukao

(10) Patent No.: US 11,262,671 B2
(45) Date of Patent: Mar. 1, 2022

(54) IMAGE FORMING APPARATUS

(71) Applicant: Oki Electric Industry Co., Ltd., Tokyo (JP)

(72) Inventor: Moriaki Fukao, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/070,302

(22) Filed: Oct. 14, 2020

(65) Prior Publication Data

US 2021/0124285 A1 Apr. 29, 2021

(30) Foreign Application Priority Data

Oct. 24, 2019 (JP) ..... JP2019-193821

(51) Int. Cl.
*G03G 15/08* (2006.01)
*G03G 21/16* (2006.01)

(52) U.S. Cl.
CPC ..... *G03G 15/0886* (2013.01); *G03G 15/0879* (2013.01); *G03G 21/1633* (2013.01); *G03G 2215/0692* (2013.01)

(58) Field of Classification Search
CPC ..... G03G 15/0886; G03G 15/0875; G03G 15/0879; G03G 2215/068; G03G 2215/0692; G03G 21/1633
USPC ..... 399/258, 262
See application file for complete search history.

(56) References Cited

U.S. PATENT DOCUMENTS

| | | | | |
|---|---|---|---|---|
| 7,805,097 | B2 * | 9/2010 | Mase | G03G 15/0896 399/258 |
| 8,873,996 | B1 * | 10/2014 | Buchanan | G03G 15/0865 399/98 |
| 9,360,797 | B1 * | 6/2016 | Bayubay | G03G 15/0889 |
| 9,690,231 | B2 * | 6/2017 | Yoshida | G03G 15/0886 |
| 10,444,669 | B2 * | 10/2019 | Sato | G03G 15/0886 |

FOREIGN PATENT DOCUMENTS

| | | | |
|---|---|---|---|
| JP | 2009-157204 A | | 7/2009 |
| JP | 2010014744 A | * | 1/2010 |
| JP | 2013160874 A | * | 8/2013 |

* cited by examiner

*Primary Examiner* — Robert B Beatty
(74) *Attorney, Agent, or Firm* — Muncy, Geissler, Olds & Lowe, P.C.

(57) ABSTRACT

An image forming apparatus includes an image forming unit that forms an image, a developer accommodation part that supplies a developer, a developer supply duct that is disposed between the image forming unit and the developer accommodation part, a shutter member that reciprocates between an open position and a closed position wherein the developer is allowed to pass through the shutter member when the shutter member is at the open position, and the developer is blocked with the shutter member when the shutter member is at the closed position, a first operation part that comprises an engaging part, which engages with the image forming unit, and moves the shutter member either to the open position or to the closed position, wherein the first operation part causes the engaging part to disengage from the image forming unit when the shutter member exists at the closed position.

11 Claims, 18 Drawing Sheets

[Top Cover Open State & Basket Internally Lifted State]

[Cover Closed State]

[Cover Closed State]

[Front Cover Open State]

[Top Cover Open State & Basket Externally Lifted State]

[Top Cover Open State & Basket Internally Lifted State]

[Stopper Unlocked State]

[Switching Lever Pushed-In State]

[Switching Lever Extracting State]

[Switching Lever Extracting State]

[Stopper Released State]

[Switching Lever Extracted State]

[Switching Lever Extracting State]

[Switching Lever Extracted State]

[Switching Lever Pushed-In State]

[Switching Lever Extracting State]

[Switching Lever Extracting State]

[Switching Lever Extracted State]

[Switching Lever Extracted State]

IMAGE FORMING APPARATUS

TECHNICAL FIELD

This invention relates to an image forming apparatus, and is preferable in applying to an electrophotographic image forming apparatus for example.

BACKGROUND

Conventionally, there are image forming apparatuses where an image forming unit and a toner cartridge are inserted or removed by opening the cover of a chassis to make the image forming unit and the toner cartridge operable by a user, or by extracting an extractable rail unit that carries the image forming unit from inside the chassis to expose the image forming unit to the outside of the chassis (see Patent Document 1 for example).

Among such image forming apparatuses, there is one where a toner is prevented from scattering out of the image forming unit and the toner cartridge by removing the image forming unit after closing toner supply ports by moving shutters that open/close the toner supply ports installed on the image forming unit and the toner cartridge by the user operating an operation part.

RELATED ART

Patent Document(s)

[Patent Doc. 1] JP Patent Application Publication No. 2009-157204

SUBJECT TO BE SOLVED

In such an image forming apparatus, its reliability is desired to be improved by preventing misoperations of the operation part.

This invention has been made by considering the above point, and proposes an image forming apparatus that can improve reliability.

SUMMARY

An image forming apparatus, disclosed in the application, includes an image forming unit that forms an image on a medium, a developer accommodation part that supplies a developer to the image forming unit, a developer supply duct that is disposed between the image forming unit and the developer accommodation part such that the developer reaches the image forming unit through the developer supply, a shutter member that reciprocates between an open position and a closed position wherein the developer is allowed to pass through the shutter member when the shutter member is at the open position, and the developer is blocked with the shutter member when the shutter member is at the closed position, a first operation part that comprises an engaging part, which engages with the image forming unit, and moves the shutter member either to the open position or to the closed position, wherein the first operation part causes the engaging part to disengage from the image forming unit when the shutter member exists at the closed position.

An image forming apparatus, disclosed in the application, includes an image forming unit that forms an image on a medium, a developer accommodation part that accommodates a developer, a developer supply duct that supplies the developer accommodated in the developer accommodation part to the image forming unit, and a shutter member that blocks the developer supply duct, wherein the image forming unit becomes detachable from the developer supply duct after the shutter member blocks the developer supply duct.

This invention allows preventing a developer from leaking out from a developer supply duct even if a developer accommodation part separates from an image forming unit by blocking the developer supply duct with shutter members.

This invention can realize an image forming apparatus that can block the developer supply duct with the shutter members to prevent a developer leaking out from the developer supply duct even if the developer accommodation part separates from the image forming unit, thereby improving reliability.

BRIEF DESCRIPTIONS OF THE DRAWINGS

DETAILED DESCRIPTION OF THE PREFERRED EMBODIMENTS

Below, embodiments of this invention are explained referring to drawings.

1. First Embodiment

[1-1. Image Forming Apparatus Configuration]

Figure 1:
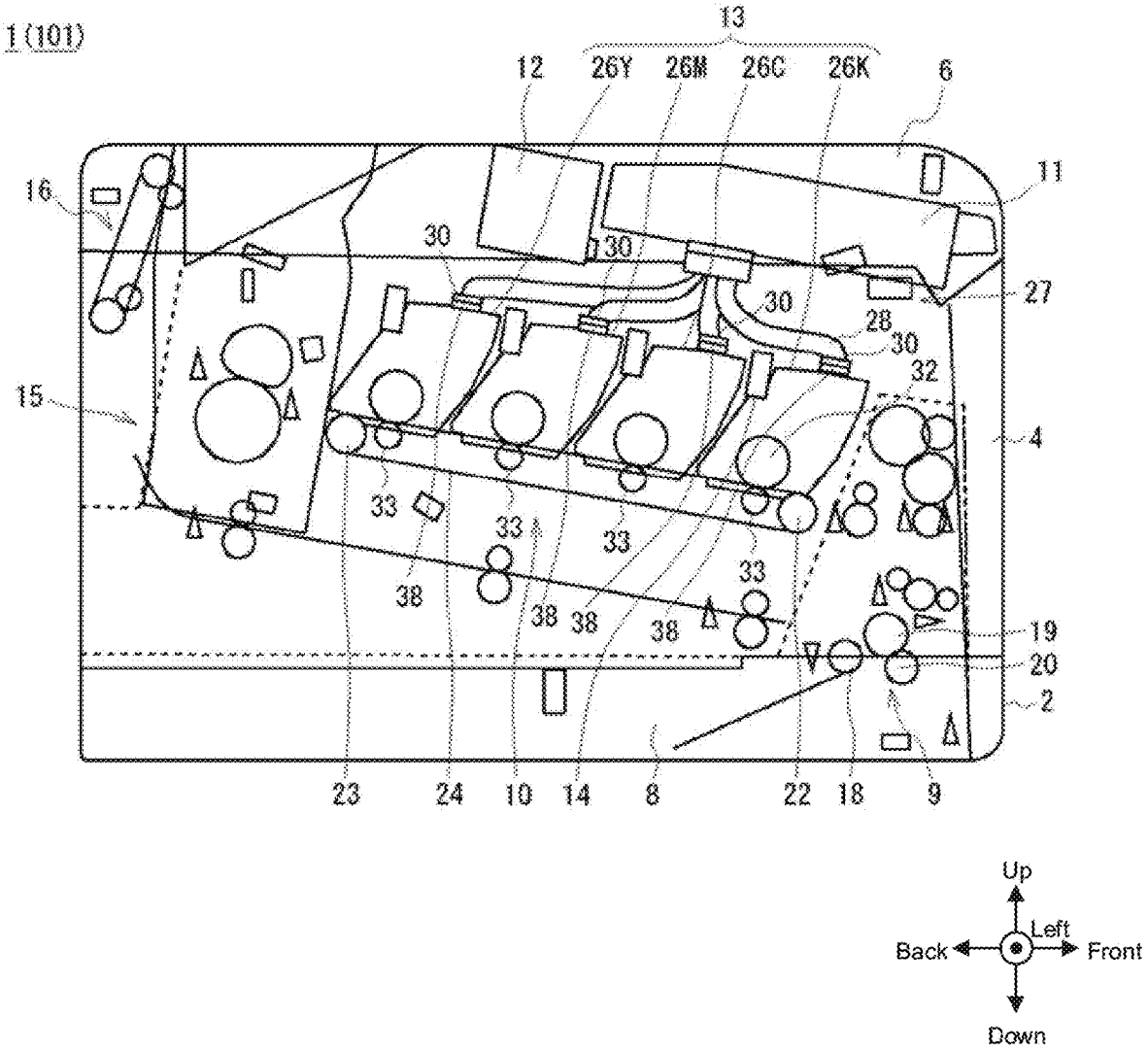
FIG. 1 is a left side view showing the whole configuration of an image forming apparatus.
Figure 2:
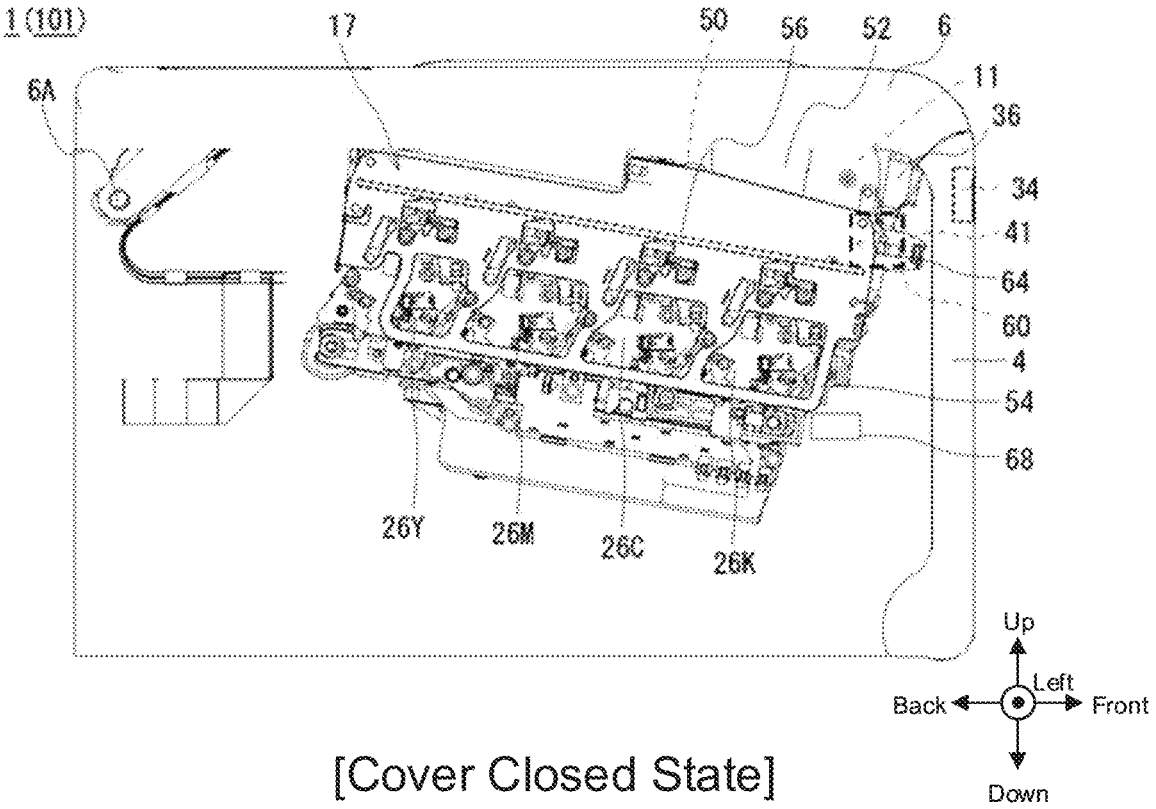
FIG. 2 is a left side view showing the configuration of the image forming apparatus in a cover closed state (1).
Figure 3:
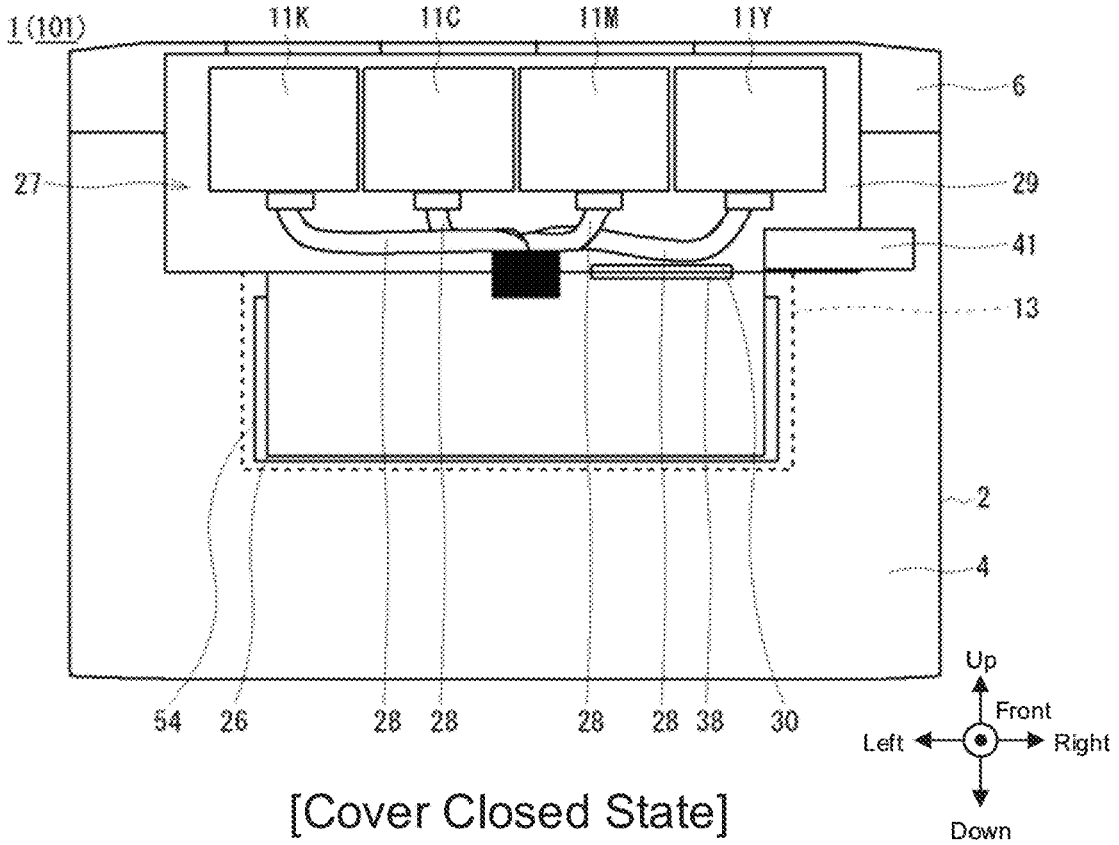
FIG. 3 is a front view showing the configuration of the image forming apparatus in the cover closed state (2).

As shown in FIGS. 1, 2, and 3, an image forming apparatus 1 is a color electrophotographic printer that prints a desired color image on a printing sheet of A3 or A4 in size for example. The image forming apparatus 1 is provided with various parts arranged inside a chassis 2 formed in an approximate box shape. The chassis 2 as the apparatus main body is provided with a front chassis opening and a top chassis opening formed respectively on the front face and the top face to make the internal space surrounded with the chassis 2 communicate with the exterior, and a front cover 4 and a top cover 6 as a cover member installed respectively on the front face and the top face that can open/close the front chassis opening and the top chassis opening, respectively. The chassis 2 protects the interior of the image forming apparatus 1 by closing the front cover 4 and the top cover 6 during a print operation. On the other hand, the chassis 2 can facilitate work on individual internal parts by opening the front cover 4 and the top cover 6 as necessary during a maintenance work performed by a worker. Incidentally, explanations hereafter are given by regarding the right end part in FIG. 1 as the front face of the image forming apparatus 1, and defining the up-down direction, the left-right direction, and the front-back direction as viewed facing this front face. The image forming apparatus 1 performs an integrated control of the whole by a control part (unshown). This control part is wirelessly or wiredly connected to a higher-level device (unshown) such as a personal computer through an unshown communication processing part. Once image data expressing a color image as a print target is given and printing of the color image is instructed by the upper-level device, the control part executes a print process to form a printed image on the surface of the printing sheet.

The image forming apparatus 1 internally has a sheet tray 8, a sheet feeding part 9, a transfer belt unit 10, toner cartridges 11, a toner carrying part 12, an image forming part 13, exposure devices 14, an image fusing part 15, a sheet ejection part 16, etc.

The sheet tray 8 is installed in the bottom part inside the chassis 2, attached in a freely detachable manner to the image forming apparatus 1, and holds printing sheets stacked inside. The sheet feeding part 9 is installed in the downstream side of the sheet tray 8 in the sheet carrying direction, and composed of a pickup roller 18, a feed roller 19, and a retard roller 20. The pickup roller 18 and the feed roller 19 are rotationally driven anticlockwise in FIG. 1 by an unshown motor. Also, the retard roller 20 generates an anticlockwise torque in FIG. 1 by an unshown torque generating means. Therefore, the pickup roller 18 extracts a printing sheet from inside the sheet tray 8, and the feed roller 19 and the retard roller 20 are arranged as a contacting pair, and even if multiple printed sheets are simultaneously extracted for example, the printing sheets are sequentially forwarded to a carrying route by one piece at a time.

Installed above the sheet tray 8 inside the chassis 2 is the transfer belt unit 10 crossing largely in the front-back direction inside the chassis 2. The transfer belt unit 10 is provided with a tension roller 22 and a drive roller 23 comprising elongated cylinders having their central axes oriented in the left-right direction disposed in the front and the back, respectively, and a transfer belt 24 stretched circling around the tension roller 22 and the drive roller 23 in the front and the back. The transfer belt 24 is formed as an endless belt with a large left-right width, and runs accompanying the rotation of the drive roller 23. The transfer belt unit 10 makes the transfer belt 24 run by rotating the drive roller 23 according to the control of the control part, and carries backward a printing sheet handed over via multiple carrying roller pairs from the sheet feeding part 9 by loading it on the top face of the transfer belt 24.

On the other hand, installed in the upper side of the transfer belt unit 10, that is upward of the center in the chassis 2, is an image forming unit 13 where four development units 26K, 26C, 26M, and 26Y (hereafter, these are also collectively called development units 26) are arranged sequentially from the front side toward the back side. That is, the individual color development units 26 are arranged in the so-called tandem system. These development units 26K, 26C, 26M, and 26Y correspond to individual colors of black (K), cyan (C), magenta (M), and yellow (Y), respectively. Also, the development units 26K, 26C, 26M, and 26Y are configured in the same manner as one another, having only their corresponding colors different. The development units 26 have their long direction along the left-right direction, and are attached in a freely detachable manner to a basket 54 (FIG. 2) in the up-down direction perpendicular to the carrying direction in the carrying route of the printing sheet. Hereafter, the development units 26 and the basket 54 are also collectively called an image forming unit 17.

The multiple toner cartridges 11 (the toner cartridges 11K, 11C, 11M, and 11Y) (FIG. 3) are attached in a freely detachable manner to a toner cartridge attaching part (unshown) installed on a top frame 50 (FIG. 2) fixed to the top cover 6 above the image forming part 13, contain toners, and supply the toners to development rollers (unshown) of the development units 26. The toner cartridges 11K, 11C, 11M, and 11Y of individual colors of black, cyan, magenta, and yellow attached to the toner cartridge attaching part supply toners to a toner carrying part 12 (FIG. 1), and the toners are supplied to the individual development units 26K, 26C, 26M, and 26Y via toner carrying ducts 28 for the individual colors. Hereafter, the toner cartridges 11 and the toner carrying ducts 28 are also called a developer accommodation part 27. This developer accommodation part 27 is installed on the top cover 6.

Installed in place where the toner carrying ducts 28 and the individual color development units 26 fit are duct shutters 30 that open/close a toner supply ports 29 (FIG. 8) installed on the lower end parts of the toner carrying ducts 28.

Installed below the duct shutters 30 are development unit shutters 38 that open/close toner receiving ports installed on the development units 26 by moving accompanying the movement of the duct shutters 30.

A basket frame 52 (FIG. 2) is a metal plate installed extending in the front-back and up-down directions at both the left and right ends inside the chassis 2, and rotates (or pivots/swings) around a rotation shaft installed on the same axis as a top cover rotation shaft 6A (or top cover pivot/swing shaft 6A) that is the rotation shaft of the top cover 6. The basket frame 52 holds the basket 54 displaceable in the front-back direction with rail parts 56. The rail parts 56 hold the basket 54 movable to a position where the development units 26K, 26C, 26M, and 26Y are exposed to the outside of the chassis 2. This basket 54 holds the development units 26K, 26C, 26M, and 26Y. The basket frame 52 and the basket 54 form a holding unit of this invention.

Installed on the top frame 50 and the basket frame 52 is a stopper mechanism 60 (FIG. 2) that makes the top frame 50 and the basket frame 52 separate or fit. In a stopper unlocked state shown in FIG. 7, once the top cover 6 is lifted, the stopper mechanism 60 also lifts the basket frame 52 together with the top frame 50 of the top cover 6.

Also, disposed on the top cover 6 side are a switching lever 41 (FIG. 7) that extends in the front-back direction in parallel to the array direction of the development units 26 and reciprocates in the front-back direction along a line slightly falling forward relative to the horizontal direction, and a stopper shaft 46 (FIG. 7) that interlocks with the switching lever 41. The stopper shaft 46 is disposed in the front side that is the opposite end side of the top cover rotation shaft 6A in the back side across the image forming unit 17.

Next, explained is the internal configuration of the development unit 26K. For example, in the development unit 26K (FIG. 1), a photosensitive drum 32 is disposed rotatable clockwise, and around this photosensitive drum 32, a charging roller (unshown), an exposure device 14, a development roller (unshown), and a cleaning blade (unshown) are arranged sequentially from the upstream side toward the downstream side in its rotational direction. The charging roller (unshown) charges the surface of the photosensitive drum 32 by supplying a charge. The exposure device 14 fits its development unit 26K and forms an electrostatic latent image by selectively irradiating the surface of the charged photosensitive drum 32 with light. The development roller (unshown) performs development by making a toner adhere onto the surface of the photosensitive drum 32 where the electrostatic latent image is formed. The cleaning blade (unshown) removes a transfer residual toner that was not transferred and remains on the photosensitive drum 32.

Transfer rollers 33 each formed of conductive rubber or the like are arranged in a state pressed against the photosensitive drums 32 of the development units 26K~26C through the transfer belt 24. Applied to these transfer rollers 33 is a potential for providing the surface potential of the individual photosensitive drums 32 and the surface potential of these individual transfer rollers 33 with a potential difference in transferring toner images with toners adhering onto the photosensitive drums 32 to a printing sheet.

The transfer belt 24 electrostatically adsorbs and carries a printing sheet. The drive roller 23 drives the transfer belt 24 together with the tension roller 22 that stretches the transfer belt 24 by forming a pair with this drive roller 23.

The image fusing part 15 comprises a roller pair of an upper roller that is disposed in the upper side of a carrying route, has a halogen lamp as a heat source inside, and has its surface formed of an elastic body, and a lower roller that is disposed in the lower side of the carrying route, has a halogen lamp as a heat source inside, and has its surface formed of an elastic body, and melts a toner image on a printing sheet forwarded from the image forming part 13 by applying heat and pressure, fusing this image to the printing sheet. Afterwards, the printing sheet is carried by multiple ejection roller pairs in the sheet ejection part 16, and in due course, ejected to a stacker part of the top cover 6.

[1-2. Cover Configuration]

As shown in FIG. 2, installed in the image forming apparatus 1 are the front cover 4 on the apparatus front face, and the top cover 6 on the apparatus top face. The front cover 4 and the top cover 6 are external members that the user can open/close. FIGS. 1, 2, and 3 show a cover closed state where both the front cover 4 and the top cover 6 are closed. In this cover closed state, the image forming apparatus 1 is in an image forming state where the photosensitive drums 32 of the individual development units 26 are in contact with the transfer belt 24 that allows forming an image on a printing sheet. The development units 26 in this image forming state are positioned in an image forming position that is a position to allow forming an image on the printing sheet.

[1-2-1. Front Cover Configuration]

The front cover 4 is installed rotatable around a rotation shaft installed on its lower end part so that its upper end part moves in the front-back direction relative to the chassis 2. Once a front cover opening lever 34 is pulled toward the near side, this front cover 4 is unlocked from the chassis 2 and opens. Also, in a front cover open state shown in FIG. 4 where its upper end part is extracted forward to expose the front chassis opening to the outside, this front cover 4 exposes the toner cartridges 11K, 11C, 11M, and 11Y to the outside of the chassis 2 into a state where the user can insert/extract them. Also, in this front cover open state, by the top cover 6 being lifted as appropriate, the user can remove a jammed sheet that is a printing sheet jammed inside the image forming apparatus 1. Furthermore, in the front cover open state, the switching lever 41 of a shutter link part 40 (FIG. 8) for opening/closing the duct shutters 30 and the development unit shutters 38 (FIGS. 1 and 3) and a top cover opening lever 36 for opening/closing the top cover 6 are arranged in positions exposed to the apparatus front face so that the user can operate them.

[1-2-2. Top Cover Configuration]

Figure 4:
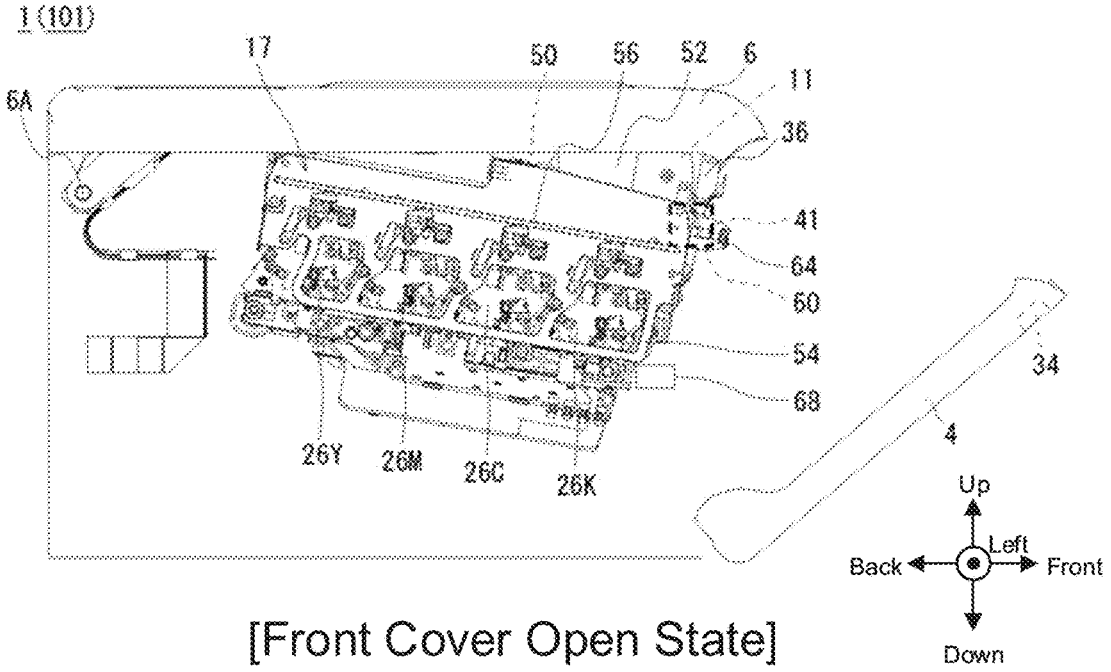
FIG. 4 is a left side view showing the configuration of the image forming apparatus in a front cover open state.
Figure 5:
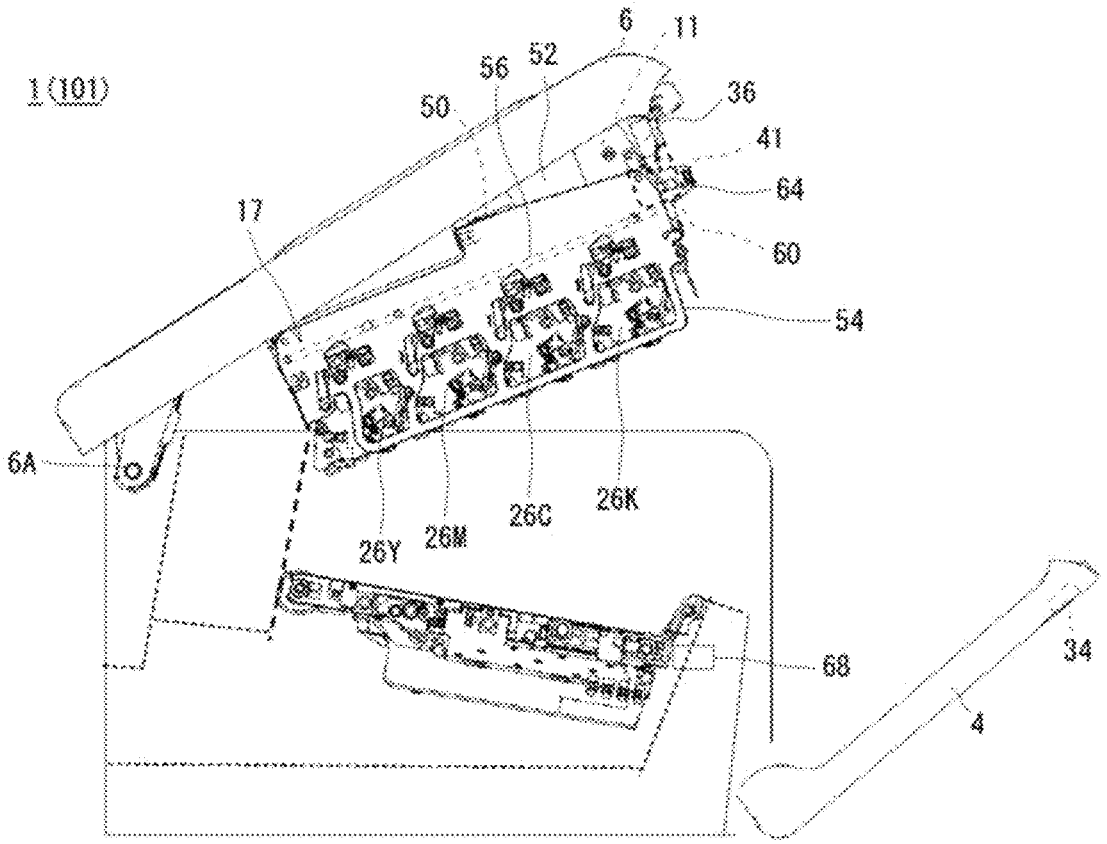
FIG. 5 is a perspective view showing the configuration of the image forming apparatus in a top cover open state and a basket externally lifted state.

The top cover 6 is installed rotatable (or pivotable/swingable) around the top cover rotation shaft 6A installed on its back end part so that its front end part moves (or pivots/swings) in the up-down direction relative to the chassis 2. Once its lower end part is pulled toward the near side so that the top cover opening lever 36 as a second operation part installed on the bottom face side of the front end part rotates anticlockwise viewed from the left side face around a top cover opening lever rotation shaft installed on the upper end part of the top cover opening lever 36, this top cover 6 is unlocked from the chassis 2 and opens. Also, once the user pulls the top cover opening lever 36 toward the near side and lifts the front end part of the top cover 6 upward without extracting the switching lever 41 toward the near side in the front cover open state (FIG. 4), this top cover 6 enters a top cover open state shown in FIG. 5. In this manner, if the top cover open state is entered without extracting the switching lever 41 toward the near side, in addition to the toner carrying part 12, the toner carrying ducts 28, and the duct shutters 30 shown in FIG. 1, and the switching lever 41 (FIG. 2) installed on the top frame 50 (FIG. 2) fixed to the top cover 6, the basket 54 where the development units 26 are accommodated is lifted together with the top cover 6 and enters a basket externally lifted state where the basket 54 rises above the top face of the chassis 2 as shown in FIG. 5. In this manner, when the stopper shaft 46 of the top cover 6 side is engaged with the basket frame 52, the image forming unit 17 is rotatable together with the top cover 6 and the developer accommodation part 27.

In this basket externally lifted state, the photosensitive drums 32 (FIG. 1) of the individual development units 26 are separated upward from the transfer belt 24, therefore the image forming apparatus 1 is in a non-image forming state where it does not form any image on a printing sheet. In this non-image forming state, the development units 26 are each in a non-image forming position where they cannot form any image on the printing sheet. Therefore, in the basket externally lifted state compared with the image forming state, the image forming apparatus 1 enlarges the up-down direction space between the development units 26 and the transfer belt 24, thereby allowing the user to remove easily a jammed sheet that is a printing sheet jammed between the development units 26 and the transfer belt 24.

Figure 6:
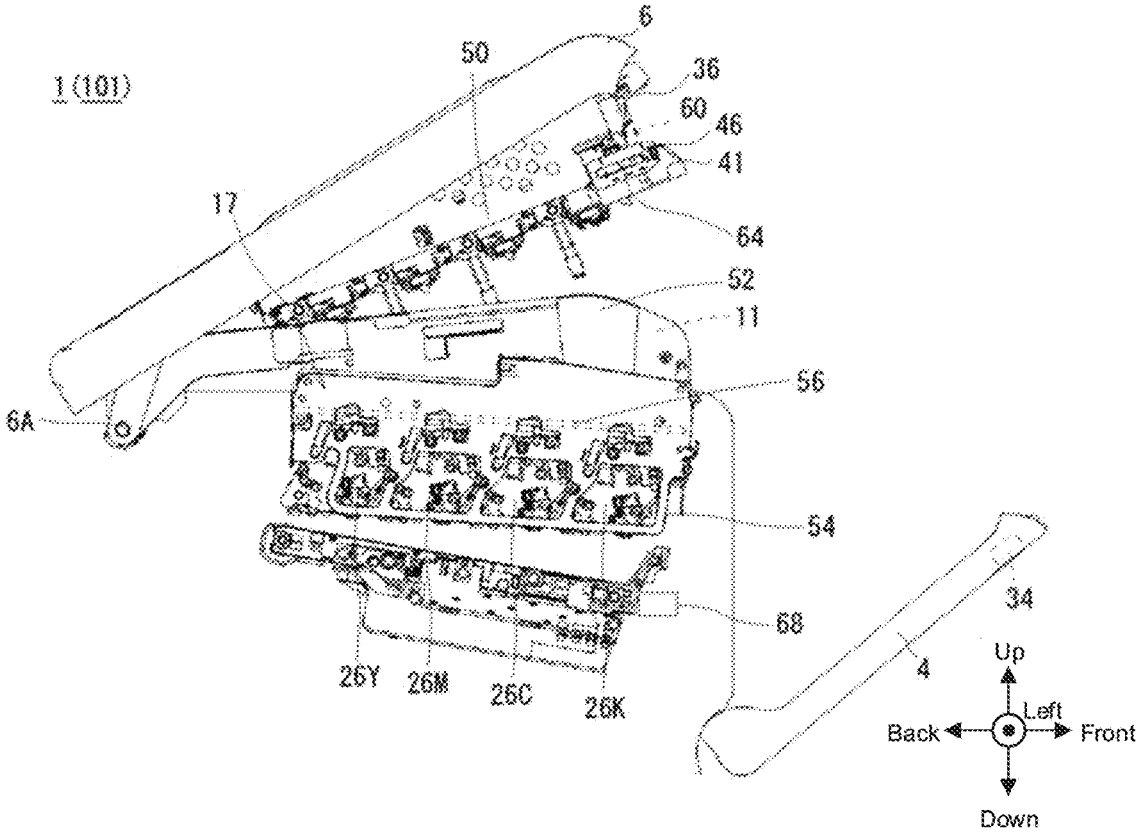
FIG. 6 is a left side view showing the configuration of the image forming apparatus in the top cover open state and a basket internally lifted state.

On the other hand, after the switching lever 41 is extracted toward the near side (FIGS. 11, 12, and 14) by the user in the front cover open state (FIG. 4), once the top cover opening lever 36 is pulled toward the near side, and afterwards the front end part of the top cover 6 is lifted upward, the top cover 6 enters the top cover open state shown in FIG. 6. In this manner, if the top cover open state is entered after the switching lever 41 is extracted toward the near side, because the top frame 50 and the basket frame 52 disengage, the toner carrying part 12, the toner carrying ducts 28, and the duct shutters 30 shown in FIG. 1, and the switching lever 41 (FIG. 2) installed on the top frame 50 are lifted together with the top cover 6. At this time, the basket 54 where the development units 26 are accommodated is slightly lifted together with the top cover 6 as shown in FIG. 6 from a basket stored state that is the image forming state where the individual development units 26 are arranged falling forward as shown in FIG. 4, and transitions to a state where the individual development units 26 are arranged in the horizontal direction, but is still in a basket internally lifted state where it is stored inside the chassis 2. In this basket internally lifted state, the image forming apparatus 1 is in the non-image forming state. Once the basket 54 is extracted toward the near side by the user in the basket internally lifted state, the image forming apparatus 1 transitions to a basket extracted state. In this basket extracted state, the development units 26 are exposed to the outside of the chassis 2, thereby the individual development units 26 enter a state where the user can attach/detach them.

Also, the top cover 6 is biased by an unshown bias member to rotate in a top cover opening direction toward the top cover open state from a top cover closed state. Therefore, once the top cover 6 is lifted by the user to a certain extent from the top cover closed state toward the top cover open state, the image forming apparatus 1 rotates the top cover 6 by a bias force of the bias member in the top cover opening direction until contacting a prescribed stopper, entering the top cover open state.

[1-3. Shutter Link Part Configuration]

Figure 8:
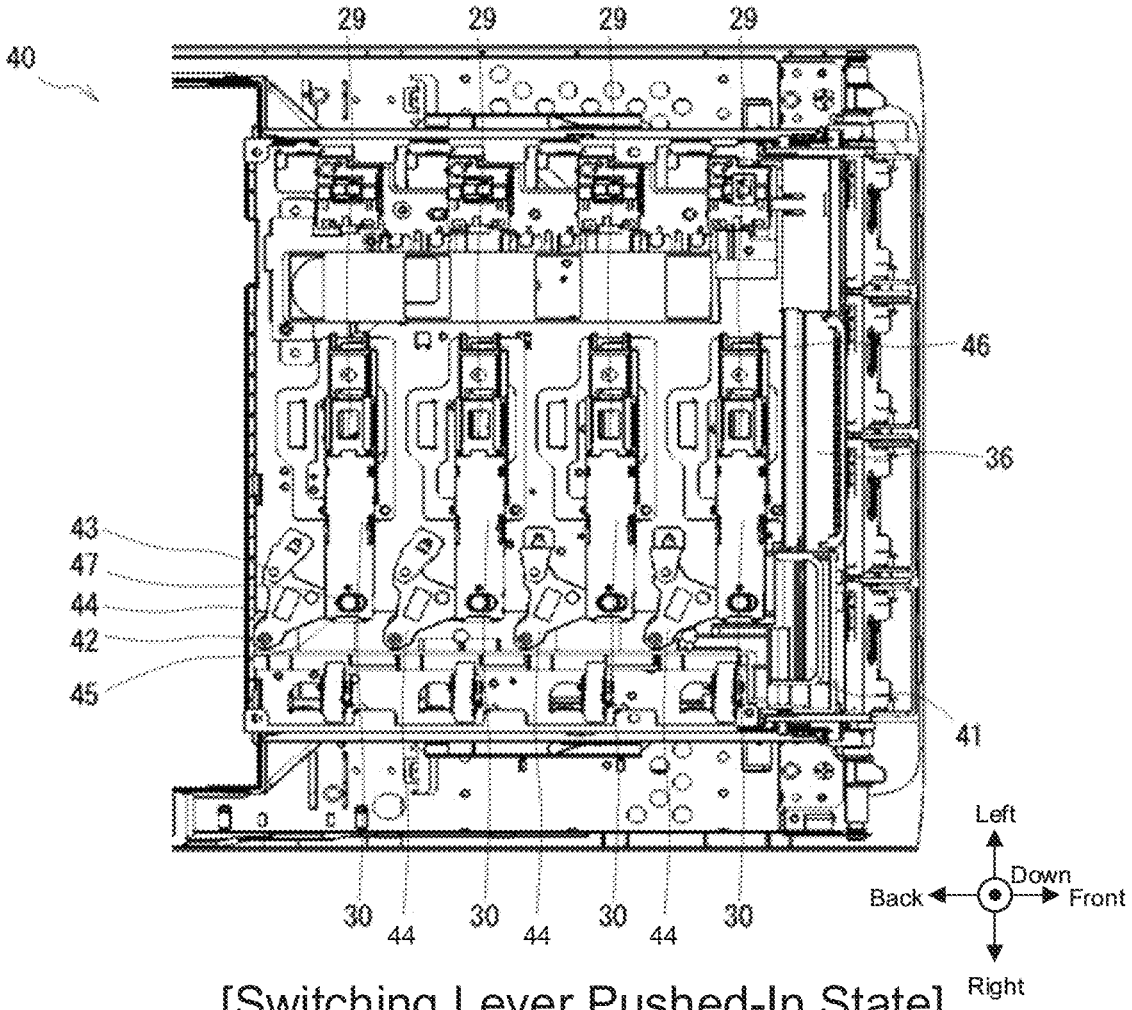
FIG. 8 is a bottom view showing the configuration of a shutter link part in a switching lever pushed-in state according to the first embodiment.
Figure 10:
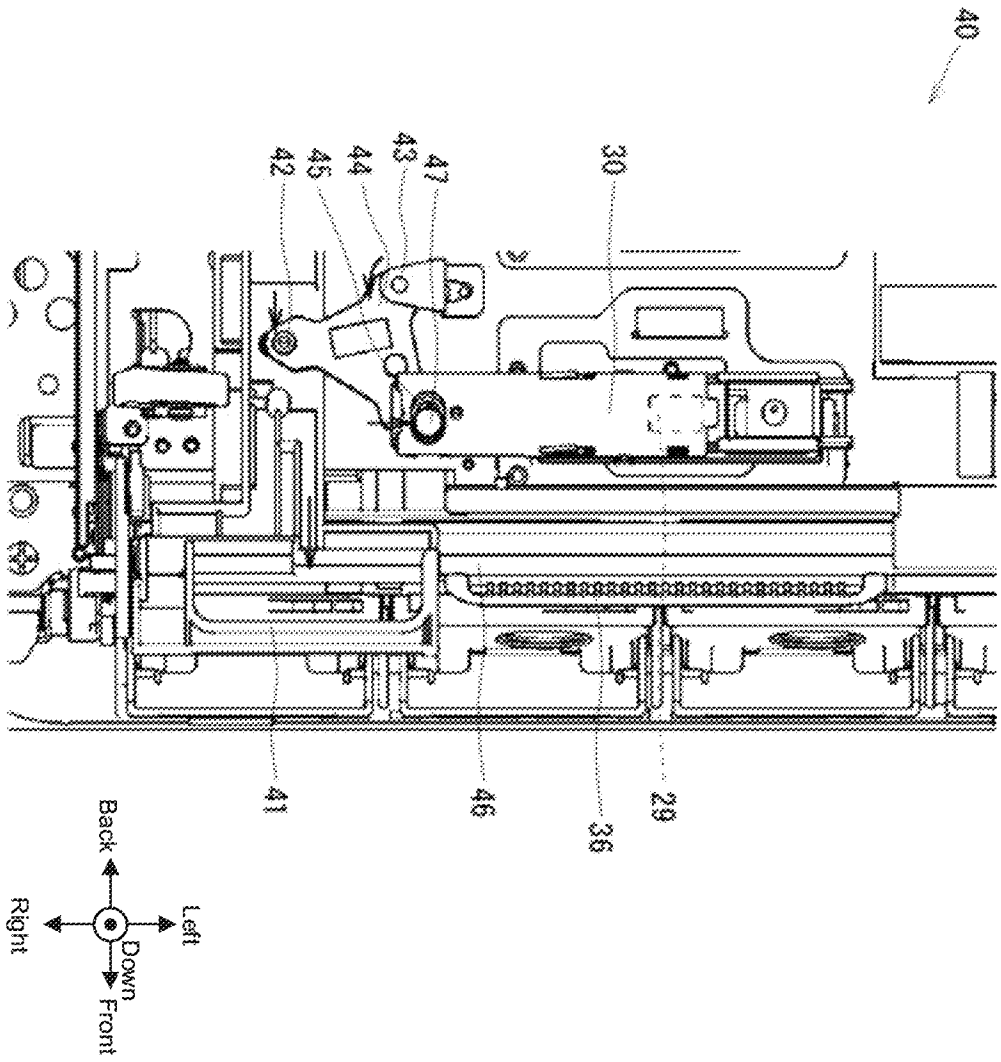
FIG. 10 is a bottom view showing the configuration of the shutter link part in a switching lever extracting state according to the first embodiment.
Figure 12:
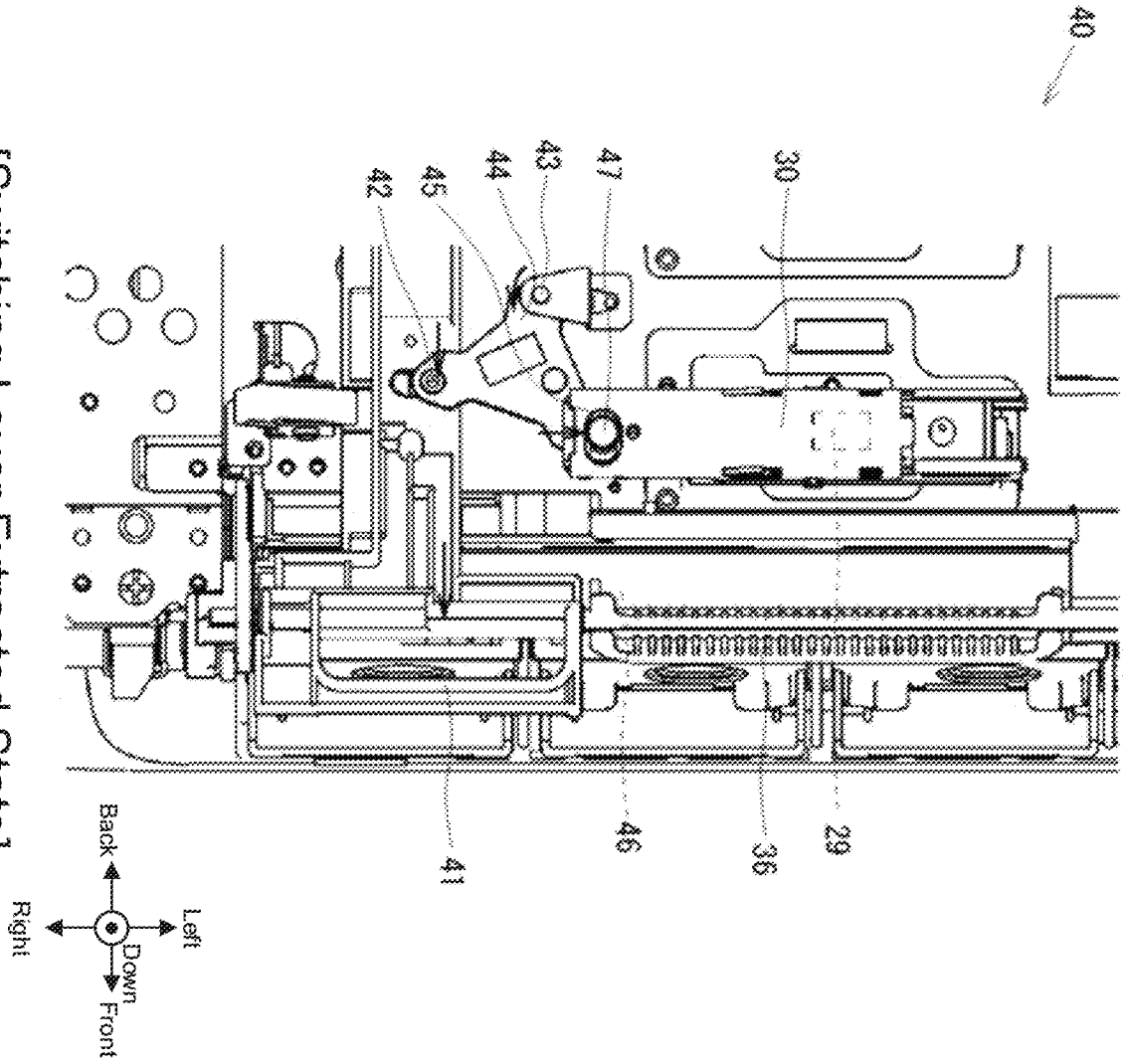
FIG. 12 is a bottom view showing the configuration of the shutter link part in a switching lever extracted state according to the first embodiment.

As shown in FIGS. 8, 10, and 12, the shutter link part 40 is installed above the development units 26, and the switching lever 41, a slider (unshown), a washer (unshown), link engaging shafts 42, lever rotation shafts 43, link levers 44, fitting parts 45, the stopper shaft 46, and the duct shutters 30 are installed. The switching lever 41 is installed on the top frame 50 (FIG. 2), and arranged movable in the front-back direction guided with the slider by the unshown washer sliding inside the slider.

Figure 7:
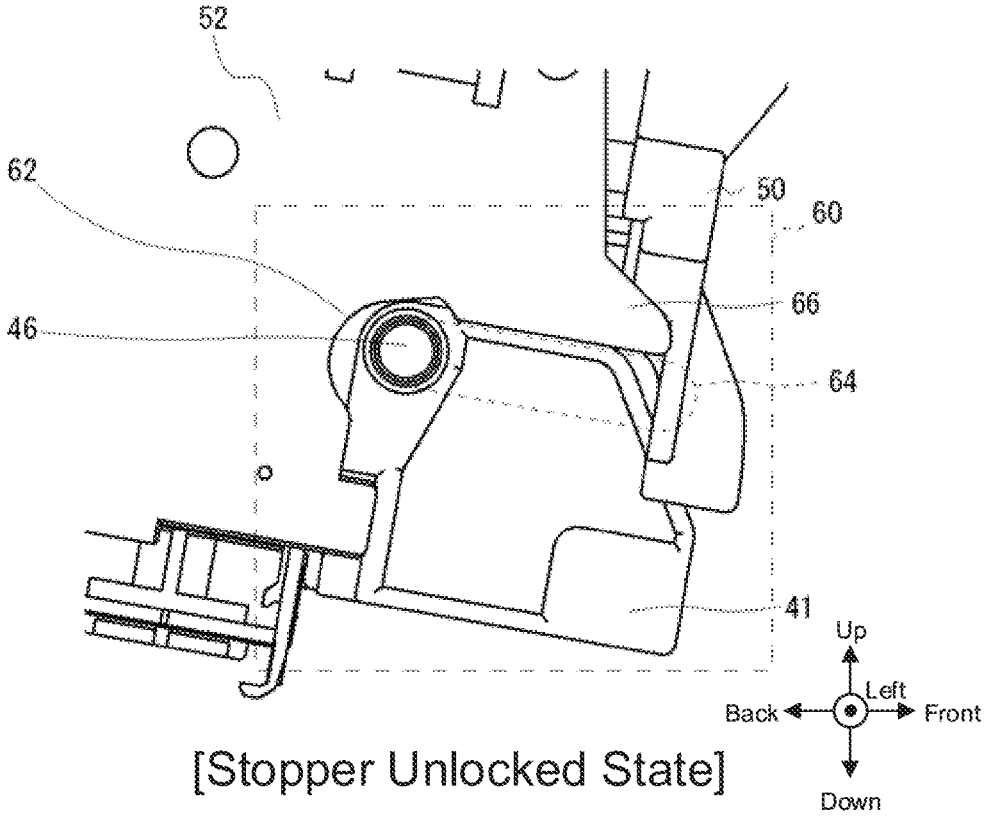
FIG. 7 is a left side view showing the configuration of a stopper mechanism in a stopper unlocked state.

FIGS. 7 and 8 show a switching lever pushed-in state where the switching lever 41 is pushed into the apparatus deep side. In this switching lever pushed-in state, once the top cover 6 is lifted, a stopper locked state (mentioned below) is entered, thereby the top frame 50 and the basket frame 52 engage, allowing the basket frame 52 to be lifted up together with the top frame 50 in a state where the basket frame 52 and the top frame 50 are physically integrated (FIG. 5), and a shutter open state (mentioned below) is entered, thereby the duct shutters 30 open the toner supply ports 29, entering a state where toners in the toner carrying part 12 are supplied to the development units 26.

Figure 11:
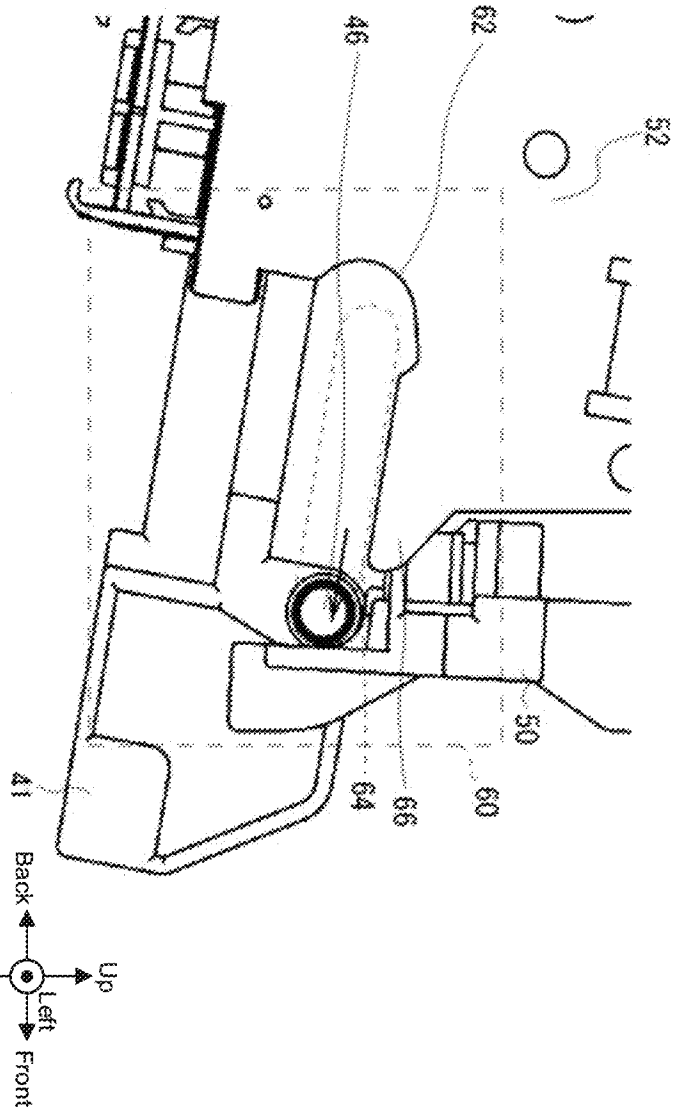
FIG. 11 is a left side view showing the configuration of the stopper mechanism in a stopper released state.
Figure 14:
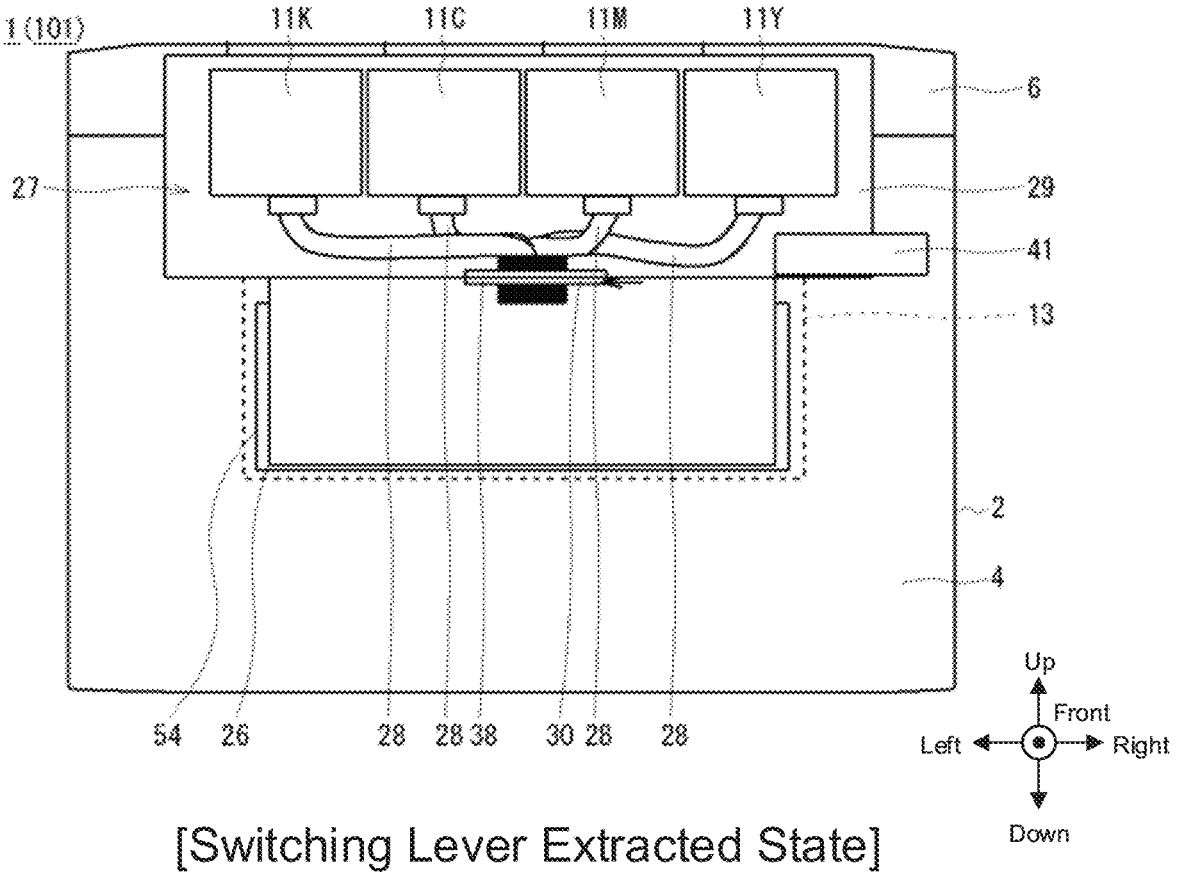
FIG. 14 is a front view showing the configuration of the image forming apparatus in the switching lever extracted state.

On the other hand, FIGS. 11, 12, and 14 show a switching lever extracted state where the switching lever 41 is extracted all the way toward the near side. In this switching lever extracted state, by entering a stopper released state (mentioned below), the top frame 50 and the basket frame 52 disengage, allowing the top frame 50 to be lifted up (FIG. 6) by physically separating the basket frame 52 and the top frame 50, and by entering a shutter closed state (mentioned below), entered is a cut-off state where the duct shutters 30 as shutter members block the toner supply ports 29, thereby toners in the toner carrying part 12 are not supplied to the development units 26.

Also, the four link levers 44 are engaged with the switching lever 41 through the link engaging shafts 42 so as to correspond to the development units 26K, 26C, 26M, and 26Y. On each link lever 44, a cylindrical shutter operation shaft 47 installed on the front end engages with the fitting part 45 that is a groove extending in the front-back direction installed on the duct shutter 30. This link lever 44 is arranged rotatable centering on the lever rotation shaft 43. The duct shutter 30 is a rectangular plate shaped member elongated in the left-right direction that is the moving direction, and installed reciprocatable in the left-right direction perpendicular to the front-back direction that is the moving direction of the switching lever 41. The duct shutters 30 are arranged so as to allow opening/closing the toner supply ports 29 of the toner carrying ducts 28 installed on the top frame 50. In this manner, by the link levers 44, the shutter link part 40 converts the front-back moving direction of the switching lever 41 into the left-right direction that is perpendicular to the front-back direction and is the long direction of the development units 26, and makes the duct shutters 30 reciprocate in the left-right direction that is the shutter moving direction.

[1-4. Locking Part Configuration]

Figure 9:
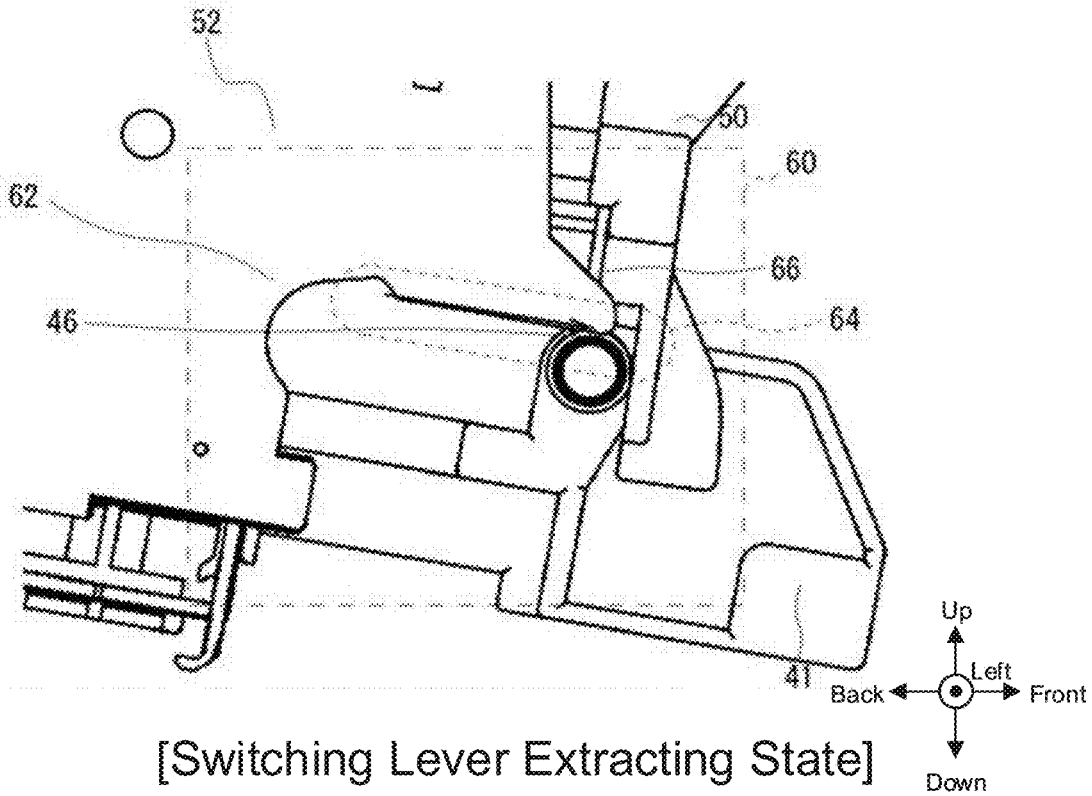
FIG. 9 is a left side view showing the configuration of the stopper mechanism in a switching lever extracting state.

As shown in FIGS. 7, 9, and 11, installed on the top frame 50 and the basket frame 52 is the stopper mechanism 60 that makes the top frame 50 and the basket frame 52 separate or fit. The stopper mechanism 60 is composed of basket locking parts 62, basket protruding parts 66, sliding holes 64, and a stopper shaft 46. The basket protruding parts 66 protrude downward forward on the left and right lower front end parts of the basket frame 52. The basket locking parts 62 are formed in the back of the basket protruding parts 66 in an upward recessed shape where the stopper shaft 46 is hooked.

The sliding holes 64 are formed on the inner side of the basket locking parts 62 in the left-right direction. These sliding holes 64 are drilled linearly in the left-right direction on the top frame 50 along the horizontal direction in the top cover closed state, and in the switching lever pushed-in state (FIGS. 7 and 8), their back ends are positioned in the same front-back direction position as the basket locking parts 62, and their front ends are positioned forward of the front ends of the basket protruding parts 66. The stopper shaft 46 is installed on the switching lever 41 in the top frame 50 side, penetrates in the left-right direction inside the left and right sliding holes 64, and is movable by sliding between the front end part and the back end part inside the sliding holes 64.

In such a configuration, in the top cover closed and switching lever pushed-in state shown in FIGS. 2, 7, and 8, because the switching lever 41 is pushed into the apparatus deep side, the stopper shaft 46 is positioned in the back end parts of the sliding holes 64. At this time, the sliding holes 64 are in a state slightly falling forward relative to the horizontal direction. Also, the lower end of the front end part of the basket 54 (FIG. 2) is in contact with the chassis-side contact part 68 fixed to the chassis 2, thereby its further rotation in the top cover closing direction is restricted. As opposed to this, the top frame 50 is not in contact with the chassis-side contact part 68, thereby its further rotation in the top cover closing direction is not restricted. Therefore, the basket frame 52 is in a state rotated slightly in the top cover opening direction relative to the top frame 50. Thereby, the basket 54 positions the basket locking parts 62 of the basket frame 52 higher than the stopper shaft 46 to keep the stopper shaft 46 unlocked from the basket locking parts 62 and prevent the basket protruding parts 66 of the basket frame 52 from entering inside the sliding holes 64. Thereby, the stopper mechanism 60 makes the sliding holes 64 enter the stopper unlocked state where the stopper shaft 46 can be moved from the back end part to the front end parts of the sliding holes 64. Also, in this stopper unlocked state, once the top frame 50 is slightly lifted, the stopper shaft 46 becomes locked with the basket locking part 62, thereby entering the stopper locked state where the top frame 50 and the basket frame 52 fit into one.

Here, it is assumed that when the user removed a jammed sheet or replaced the transfer belt unit 10, the basket frame 52 was lifted together with the top frame 50 and rotated in the top cover opening direction as shown in FIG. 5 from the state in FIG. 4 in the switching lever pushed-in state as shown in FIGS. 7 and 8, that is, while the stopper shaft 46 was still positioned in the back end parts of the sliding holes 64. At this time, the basket frame 52 attempts to rotate in the top cover closing direction by its own weight, and the top frame 50 is biased in the top cover opening direction by the bias member, therefore the stopper shaft 46 enters inside the basket locking parts 62, entering the stopper locked state. In this stopper locked state, even if the user attempts to pull the switching lever 41 toward the near side, because the stopper shaft 46 had bitten into basket locking parts 62, the switching lever 41 will not move toward the near side. Thereby, the stopper mechanism 60 can prevent the switching lever 41 from being extracted toward the apparatus near side and entering the switching lever extracted state when the top frame 50 and the basket frame 52 are lifted in the switching lever pushed-in state. Thereby, when the top frame 50 and the basket frame 52 are lifted as one unit, that is, when the top cover 6 and the development units 26 are rotated in the top cover opening direction as one unit, entering the non-image forming state, the stopper mechanism 60 can prevent an incidence that the switching lever 41 is extracted toward the apparatus near side by a user's misoperation, the top frame 50 and the basket frame 52 disengage, and the development units 26 fall down.

On the other hand, in the switching lever extracted state shown in FIGS. 11, 12, and 14, because the switching lever 41 is extracted all the way toward the apparatus near side from the state shown in FIGS. 7 and 8, the stopper shaft 46 is positioned in the front end parts of the sliding holes 64. In this switching lever extracted state, because the stopper shaft 46 is positioned forward of the front ends of the basket protruding parts 66 of the basket frame 52, the stopper shaft 46 and the basket locking parts 62 and the basket protruding parts 66 are unlocked, entering the stopper released state where the basket frame 52 and the top frame 50 are physically separated and movable independently of each other.

Once the top cover opening lever 36 is pulled toward the near side and the top cover 6 is lifted upward from this stopper released state, the image forming apparatus 1 enters the top cover open and basket internally lifted state as shown in FIG. 6 while the stopper shaft 46 is still positioned in the front end parts of the sliding holes 64.

[1-5. Jammed Sheet Removal Procedure and Transfer Belt Unit Replacing Procedure]

Next, explained are the procedure for the user to remove a jammed sheet jammed between the development units 26 and the transfer belt 24, and the procedure to replace the transfer belt unit 10 that reached the end of its life. First, once the user pulls the front cover opening lever 34 toward the near side and opens the front cover 4 in the cover closed state (FIG. 2), the image forming apparatus 1 transitions to the front cover open state shown in FIG. 4. In this front cover open state, the switching lever 41 and the top cover opening lever 36 are exposed to the outside of the chassis 2.

Also at this time, the switching lever 41 is in the switching lever pushed-in state (FIG. 8), and as shown in FIG. 7, the stopper shaft 46 is positioned in the deep sides of the sliding holes 64 in the stopper unlocked state. In this stopper unlocked state, once the user pulls the top cover opening lever 36 toward the near side, as shown in FIG. 5, the top frame 50 side and the basket frame 52 rotate simultaneously while still mutually engaged, and enter the top cover open and basket externally lifted state that is the non-image forming state. In this top cover open and basket externally lifted state, because the lower end part of the basket 54 separates upward from the transfer belt 24, the user either removes the jammed sheet or replaces the transfer belt unit 10. Hereafter, the top cover open and basket externally lifted state (FIG. 5) is also called a first cover open mode.

In this manner, by the user only operating the top cover opening lever 36 in the switching lever pushed-in state, the image forming apparatus 1 can rotate the top frame 50 side and the basket 54 simultaneously while still mutually engaged to enter the top cover open and basket externally lifted state, allowing the user to remove the jammed sheet or replace the transfer belt unit 10 easily without forcing a complex work.

Also, in the top cover open state, the image forming apparatus 1 locks the stopper shaft 46 in a state of biting into the basket locking parts 62 to enter the stopper locked state. Therefore, the image forming apparatus 1 can prevent the switching lever 41 from being extracted toward the apparatus near side in the top cover open state and entering the switching lever extracted state. Thereby, the image forming apparatus 1 can prevent an incidence that the switching lever 41 is extracted toward the apparatus near side by a user's misoperation in the top cover open state, the top frame 50 and the basket frame 52 disengage, and the development units 26 fall down.

[1-6. Development Units Replacing Procedure]

Next, explained is the procedure for the user to replace a development unit 26 that reached the end of its life. First, in the cover closed state (FIG. 2), once the user pulls the front cover opening lever 34 toward the near side and opens the front cover 4, the image forming apparatus 1 transitions to the front cover open state shown in FIG. 4. In this front cover open state, the switching lever 41 and the top cover opening lever 36 are exposed to the outside of the chassis 2. Subsequently, once the user extracts the switching lever 41 toward the near side from the switching lever pushed-in state shown in FIGS. 7 and 8, the image forming apparatus 1 transitions to the switching lever extracted state shown in FIGS. 11, 12, and 14. At this time, once the switching lever 41 moves forward, the link engaging shafts 42 of the four link levers 44 linked with the switching lever 41 move forward. Thereby, the link levers 44 rotate anticlockwise in the bottom view centering on the lever rotation shafts 43, and the shutter operation shafts 47 also rotate anticlockwise in the bottom view. The fitting parts 45 move by the shutter operation shafts 47 that rotate anticlockwise in the bottom view, and move together with the duct shutters 30 in a shutter closing direction that is the left direction among directions perpendicular to the moving direction of the switching lever 41.

Here, in the switching lever pushed-in state (FIGS. 7 and 8), the duct shutters 30 are in the open position, and open the toner supply ports 29 installed on the toner carrying ducts 28. At this time, the development unit shutters 38 (FIGS. 1 and 3) move interlocked with the duct shutters 30, and make the toner carrying ducts 28 communicate with the development units 26. Thereby, the image forming apparatus 1 enters a toner suppliable state where toners supplied from the toner carrying part 12 can be supplied to the development units 26. This state is also called a shutter open state.

On the other hand, in the switching lever extracted state shown in FIGS. 11, 12, and 14 where the switching lever 41 is extracted for taking out the development unit 26, the duct shutters 30 move in the shutter closing direction to a closed position where the duct shutters 30 block the toner supply ports 29. At this time, the development unit shutters 38 move interlocked with the duct shutters 30, and block the toner receiving ports on the development unit 26 side. Thereby, the image forming apparatus 1 enters the cut-off state where toners in the toner carrying part 12 are not supplied to the development units 26. This state is also called a shutter closed state. Thereby, the image forming apparatus 1 prevents toners from leaking from the toner supply ports 29 of the toner carrying ducts 28 and scattering.

Here also, in the switching lever pushed-in state in the top cover closed state, as shown in FIG. 7, the stopper shaft 46 is positioned in the back end parts of the sliding holes 64 lower than the basket locking parts 62, that is the stopper unlocked state. In this stopper unlocked state, once the switching lever 41 is extracted, the stopper shaft 46 installed on the switching lever 41 is guided with the sliding holes 64 simultaneously with the switching lever 41, and moves slightly falling forward relative to the horizontal direction toward a shaft disengaging direction that is the forward direction.

Once the switching lever extracted state is entered in due course, as shown in FIG. 11, the stopper shaft 46 becomes positioned in the front end parts of the sliding holes 64 forward of the basket protruding parts 66, entering the stopper released state. In this stopper released state, because the stopper shaft 46 and the basket frame 52 are disengaged, the top frame 50 and the basket frame 52 are disengaged. In this stopper released state, once the user operates the top cover opening lever 36, as shown in FIG. 6, only the top frame 50 rotates in a state where the top frame 50 is disengaged from the basket frame 52, entering the top cover open state while remaining in the basket internally lifted state. Hereafter, the top cover open and basket externally lifted state (FIG. 6) is also called a second cover open state.

Figure 13:
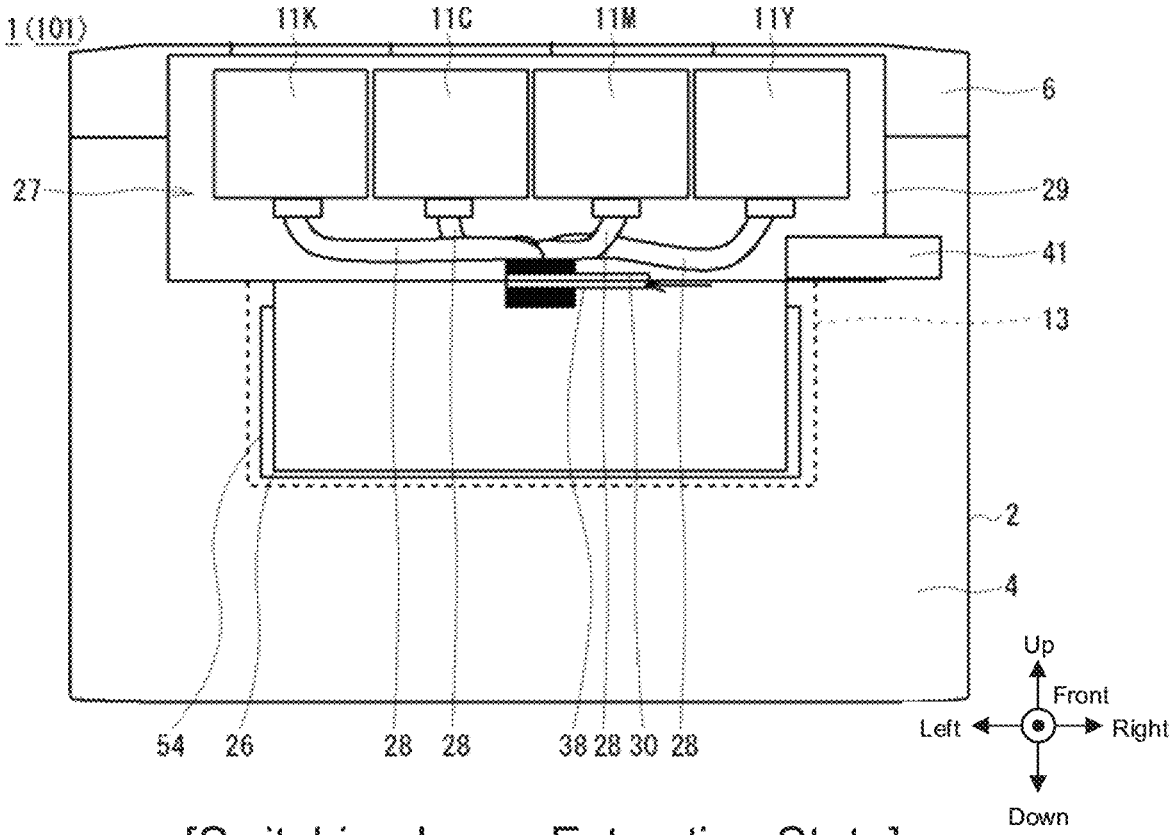
FIG. 13 is a front view showing the configuration of the image forming apparatus in the switching lever extracting state.

Here, investigated is the switching lever extracting state shown in FIGS. 10 and 13 that is a state transitioning from the switching lever pushed-in state to the switching lever extracted state by the switching lever 41 being extracted forward by the user. First, once the user extracts the switching lever 41 toward the near side from the switching lever pushed-in state (FIGS. 7 and 8), the duct shutters 30 interlocked with the switching lever 41 start moving in the shutter closing direction, and gradually close the toner supply ports 29. At the same time, the stopper shaft 46 interlocked with the switching lever 41 also starts moving forward. Hereafter, the state where the duct shutters 30 are transitioning from the shutter open state to the shutter closed state is called a shutter transition state.

As the user continues to pull the switching lever 41 toward the near side, once the stopper shaft 46 has moved to a position shown in FIG. 9, the duct shutters 30 move in the shutter closing direction accompanying the movement of the switching lever 41, and reach the closed position covering completely the toner supply ports 29 as shown in FIGS. 10 and 13. Thereby, the duct shutters 30 close the toner supply ports 29 into a state where toners do not leak from the toner supply ports 29, and the development unit shutters 38 move interlocked with the duct shutters 30 and block the toner receiving ports on the development unit 26 side. However, at this time, as shown in FIG. 9, the stopper shaft 46 is still positioned below the basket protruding parts 66 and has not transitioned to the stopper released state, therefore the basket frame 52 and the top frame 50 remain linked. As the user continues to pull the switching lever 41 toward the near side, and once the stopper shaft 46 moves to a position shown in FIG. 11 and becomes disengaged from the basket protruding parts 66, entering the stopper released state, the link state between the basket frame 52 and the top frame 50 is released.

Here, as shown in FIGS. 10 and 13, even after the duct shutters 30 reach the closed position, if the switching lever 41 is extracted toward the near side, the duct shutters 30 move further in the shutter closing direction. For this situation, when they reached the closed position, in the side of the shutter opening direction, that is the opposite direction (right direction) of the shutter closing direction, of the parts covering the toner supply ports 29, the duct shutters 30 have a greater length in the shutter moving direction than the distance that the duct shutters 30 move when the switching lever 41 moves afterwards to the switching lever extracted state. Therefore, the image forming apparatus 1 continues to block the toner supply ports 29 with the duct shutters 30 whose long direction is along the shutter moving direction, and maintains the shutter closed state until the switching lever 41 reaches the stopper released state.

In this manner, when replacing a development unit 26, the user extracts the switching lever 41 toward the near side and afterwards operates the top cover opening lever 36, thereby making the image forming apparatus 1 enter the top cover open and basket internally lifted state. Once the user extracts the basket 54 toward the apparatus near side in this basket internally lifted and top cover open state, the image forming apparatus 1 transitions from the basket internally lifted state to the basket extracted state that is the non-image forming state. In this basket extracted state, the development units 26 are exposed to the outside of the chassis 2, entering a state where the development units 26 can be attached or detached by the user. The user replaces an arbitrary development unit 26 in this basket extracted state, and performs the reverse procedure of the above-mentioned procedure. That is, the user pushes the basket 54 back to the apparatus deep side, returning to the basket internally lifted state (FIG. 6). Afterwards, the user closes the top cover 6 to enter the top cover closed state, then pushes the switching lever 41 back to the apparatus deep side, entering the switching lever pushed-in state (FIGS. 4, 7, and 8) that is the toner suppliable state, and closes the front cover 4 to enter the cover closed state (FIG. 2), thereby completing the replacement of the development unit 26.

[1-7. Actions and Effects]

In the image forming apparatus 1 of the above configuration, operating one switching lever 41 along the front-back direction allows opening/closing the duct shutters 30 and the development unit shutters 38 and attaching/detaching the basket frame 52 and the top frame 50. Therefore, the image forming apparatus 1 can concentrate opening/closing the duct shutters 30 and the development unit shutters 38 and attaching/detaching the basket frame 52 and the top frame 50 into one switching lever 41 without performing them with separate operation parts, allowing miniaturization of the image forming apparatus 1 and simplifying the user's operation.

By the way, in a conventional image forming apparatus, if a user attempts to replace a development unit without closing duct shutters by mistake, toners could scatter into the apparatus from open toner supply ports.

As opposed to this, in the image forming apparatus 1, when the duct shutters 30 interlocked with the switching lever 41 reach the shutter closed state, the switching lever 41 has not reached the stopper released state, and the stopper shaft 46 is still positioned below the basket protruding parts 66. That is, in the image forming apparatus 1, when the user replaces a development unit 26, after the duct shutters 30 that moved in the shutter closing direction from the open position reach the closed position, even if the switching lever 41 is extracted toward the near side and the duct shutters 30 move further in the shutter closing direction, the toner supply ports 29 continue to be covered with the duct shutters 30 whose long direction is along the shutter moving direction, thereby the shutter closed state is maintained until the switching lever 41 reaches the stopper released state.

Therefore, the image forming apparatus 1 can separate the basket frame 52 and the top frame 50 after the duct shutters 30 securely enter the shutter closed state. Thereby, the image forming apparatus 1 can prevent an incidence that the duct shutter 30 is in the shutter transition state, and the stopper released state is entered while the duct shutters 30 are still in the middle their movements having at least part of the toner supply ports 29 open (that is, the toner supply ports 29 are partially closed), the basket frame 52 and the top frame 50 separate, and toners leak from the toner carrying ducts 28 in the top frame 50 side.

Thereby, the image forming apparatus 1 allows replacing the development units 26 only in a state where the toner supply ports 29 are securely closed with the duct shutters 30, and therefore can prevent the top cover 6 from opening or closing when the duct shutters 30 are in midway positions. Thus, the image forming apparatus 1 can prevent toners from leaking from the toner carrying ducts 28 and scattering.

In this manner, the image forming apparatus 1 can securely take the first cover open mode that allows lifting the development units 26 and accessing the interior by opening the top cover 6 while the development units 26 and the toner carrying ducts 28 remain fit, and the second cover open mode that allows accessing the development units 26 by opening the top cover 6 in a state where the toner carrying ducts 28 are securely blocked with the duct shutters 30, thereby enhancing usability.

According to the above configuration, the image forming apparatus 1 has the image forming unit 17 that forms an image on a printing sheet as a medium, the developer accommodation part 27 that supplies toners as developers to the image forming unit 17 via the toner carrying ducts 28 as developer supply ducts, the duct shutters 30 that block the toner carrying ducts 28, and the stopper shaft 46 as an engaging part that engages with the image forming unit 17, and the switching lever 41 is installed for moving the duct shutters 30 to block the toner carrying ducts 28 so that the switching lever 41 disengages the image forming unit 17 and the stopper shaft 46 after blocking the toner carrying ducts 28 with the duct shutters 30.

Thereby, the image forming apparatus 1 can prevent toners from leaking from the toner carrying ducts 28 to the outside by blocking the toner carrying ducts 28 with the duct shutters 30 even if the developer accommodation part 27 separates from the image forming unit 17.

2. Second Embodiment

[2-1. Image Forming Apparatus Configuration]

Figure 15:
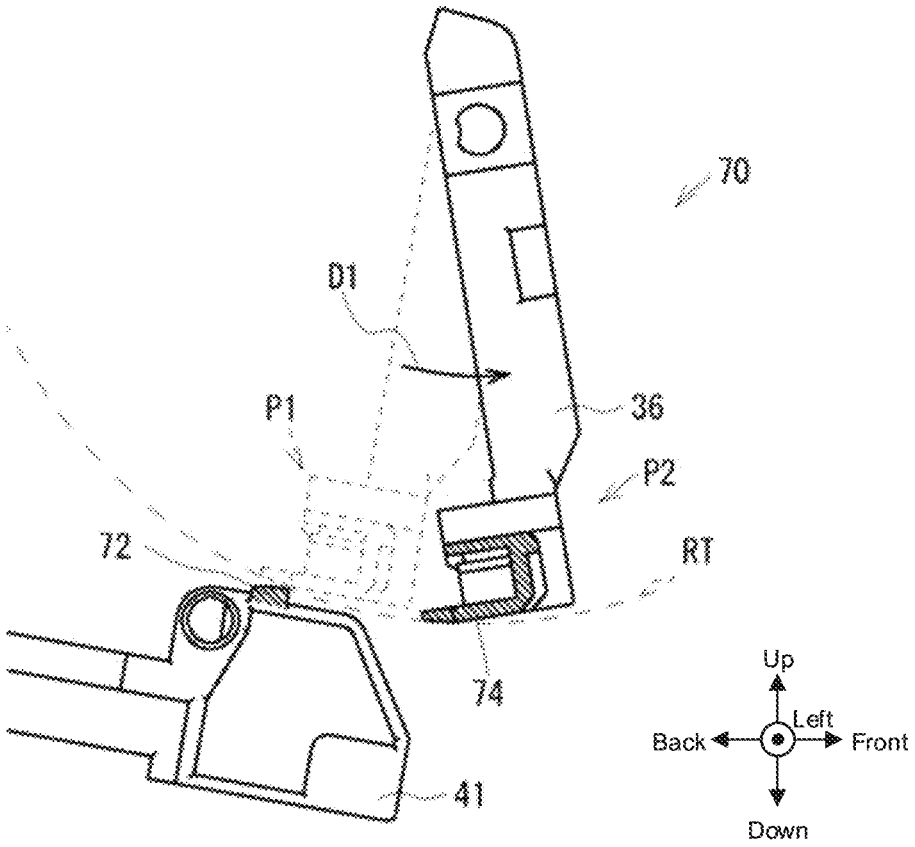
FIG. 15 is a left side view showing the configuration of a stopper mechanism in a switching lever pushed-in state according to the second embodiment.

As shown in FIG. 1, compared with the image forming apparatus 1 by the first embodiment, although an image forming apparatus 101 by the second embodiment has a difference in that a top cover opening lever stopper mechanism 70 shown in FIG. 15 is added, the others are configured in the same manner.

[2-2. Stopper Mechanism Configuration]

As shown in FIG. 15, the top cover opening lever stopper mechanism 70 is composed of a switching lever protruding part 72 protruding upward on the upper end part of the front end of a switching lever 41, and a top cover opening lever contact part 74 protruding downward on the lower end part of a top cover opening lever 36 installed above the switching lever 41.

Here, the top cover opening lever 36 can rotate so that the lower end part moves back and forth on an arc-shaped track centering on a top cover opening lever rotation shaft installed on the upper end part. The lower end part of this top cover opening lever 36 is pulled toward the near side so that the top cover opening lever 36 rotates from a locked posture P1 shown in broken lines in FIG. 15 where it is locked to a chassis 2 in a top cover opening lever unlocking direction D1 that is an anticlockwise direction in the left side view, and upon entering an unlocked posture P2 shown in solid lines in FIG. 15, it is unlocked, releasing a top cover 6. At this time, the top cover opening lever 36 has its lower end part that comes closest to the switching lever 41 move along a top cover opening lever tip rotational trajectory RT.

The switching lever 41 can reciprocate along a linear direction slightly falling forward relative to the horizon. Once its front end part is pulled toward the near side so as to move linearly in a switching lever extracting direction D2 (FIG. 18) that is the forward direction, this switching lever 41 enters a switching lever extracted state mentioned above (or described in the first embodiment). In this switching lever extracted state, by entering a shutter closed state as mentioned above (or described in the first embodiment), duct shutters 30 block toner supply ports 29, entering a cut-off state where toners in a toner carrying part 12 are not supplied to development units 26.

Here, in a switching lever pushed-in state shown in FIG. 15, the switching lever 41 is in the most backward position by design, and the switching lever protruding part 72 is positioned below the top cover opening lever tip rotational trajectory RT, that is outside the range where the top cover opening lever 36 moves. Therefore, the switching lever protruding part 72 of the switching lever 41 is sheltered from the top cover opening lever tip rotational trajectory RT, and does not contact the top cover opening lever 36 that rotates from the locked posture P1 in the top cover opening lever unlocking direction D1. Thereby, the top cover opening lever 36 can rotate in the top cover opening lever unlocking direction D1 without being obstructed by the switching lever 41 (that is, without being physically interfered with), and enters the unlocked posture P2.

Therefore, in the switching lever pushed-in state, that is a shutter open state, the image forming apparatus 1 can allow the user to pull the top cover opening lever 36 toward the near side so that it rotates in the top cover opening lever unlocking direction D1, and open the top cover 6. Thereby, the image forming apparatus 1 can enter a first cover open mode mentioned above (FIG. 5) in a state where the development units 26 and the toner supply ports 29 of the toner carrying ducts 28 fit.

Figure 16:
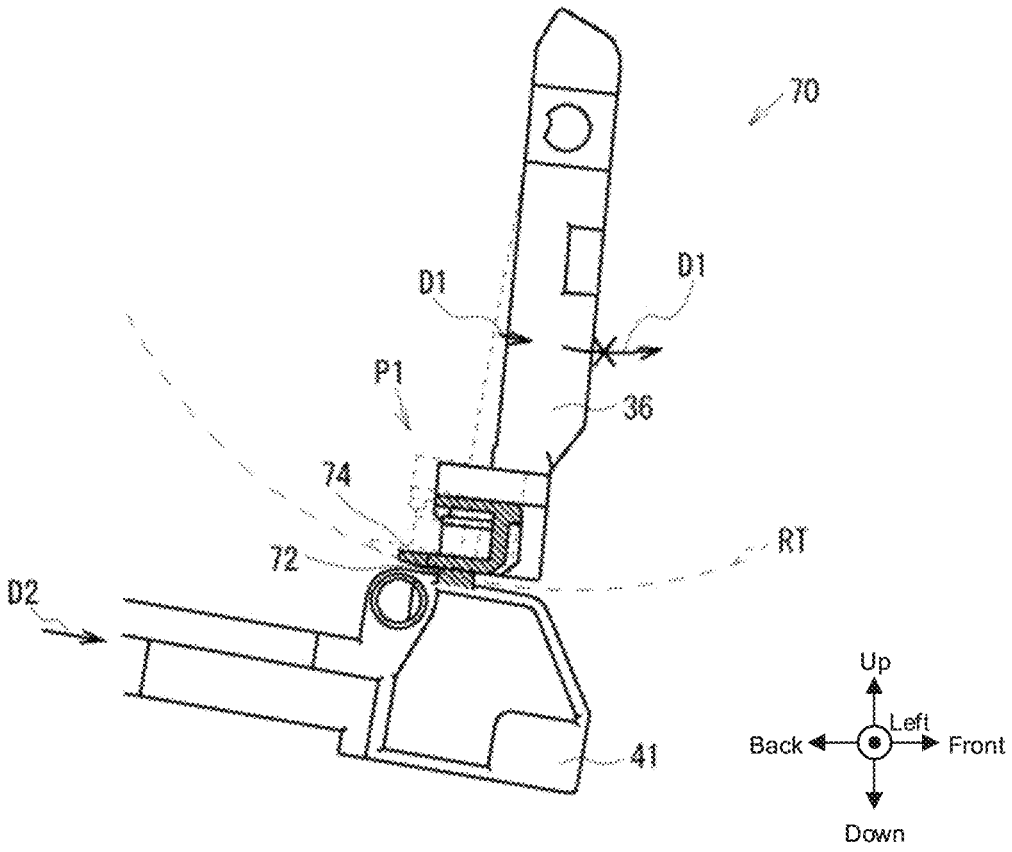
FIG. 16 is a left side view showing the configuration of the stopper mechanism in a switching lever extracting state according to the second embodiment (1).

On the other hand, in a switching lever extracting state shown in FIG. 16 that is a state transitioning from the switching lever pushed-in state to the switching lever extracted state by the switching lever 41 being extracted by the user in the switching lever extracting direction D2, the switching lever protruding part 72 is positioned on the top cover opening lever tip rotational trajectory RT. Therefore, the switching lever 41 contacts and interferes with the top cover opening lever 36 that rotates in the top cover opening lever unlocking direction D1. Thereby, the top cover opening lever 36 is physically interfered with and prevented from moving by the switching lever 41, and becomes unable to move further in the top cover opening lever unlocking direction D1.

Therefore, in a state transitioning from the shutter open state to the shutter closed state, that is a state where the duct shutters 30 are in the middle of closing the toner supply ports 29, the image forming apparatus 1 can prevent the user from rotating the top cover opening lever 36 in the top cover opening lever unlocking direction D1 and opening the top cover 6.

Figure 17:
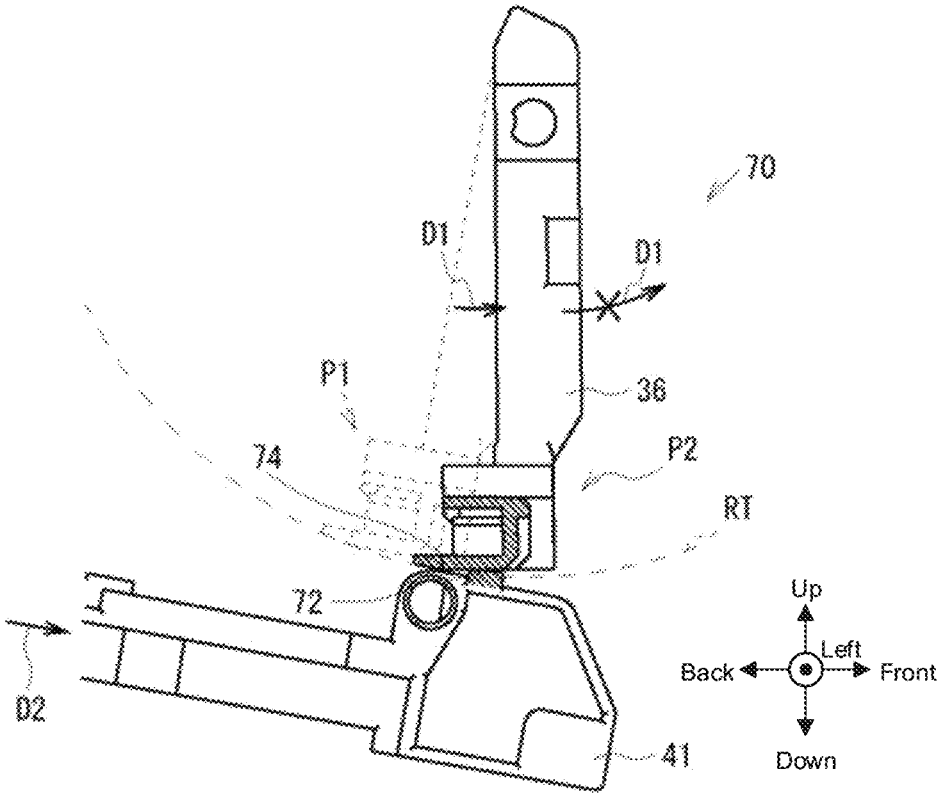
FIG. 17 is a left side view showing the configuration of the stopper mechanism in the switching lever extracting state according to the second embodiment (2).

Even after the switching lever 41 is further extracted by the user in the switching lever extracting direction D2 from the state shown in FIG. 16, entering the switching lever extracting state shown in FIG. 17, the switching lever protruding part 72 is still positioned on the top cover opening lever tip rotational trajectory RT. Therefore, the switching lever 41 contacts and interferes with the top cover opening lever 36 that rotates in the top cover opening lever unlocking direction D1. Thereby, the top cover opening lever 36 is physically interfered with and prevented from moving by the switching lever 41, and becomes unable to move further in the top cover opening lever unlocking direction D1.

Therefore, even in a state transitioning from the shutter open state to the shutter closed state, that is, a state immediately before the duct shutters 30 completely close the toner supply ports 29, the image forming apparatus 1 can prevent the user from rotating the top cover opening lever 36 in the top cover opening lever unlocking direction D1 and opening the top cover 6.

Figure 18:
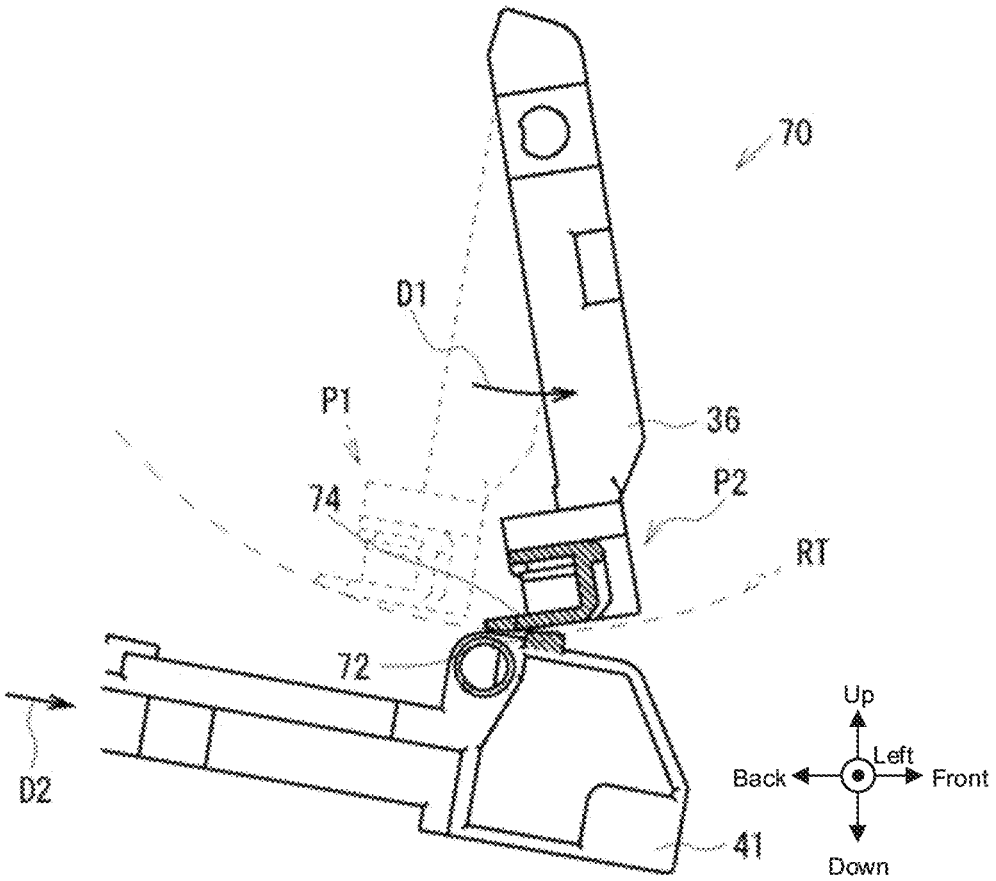
FIG. 18 is a left side view showing the configuration of the stopper mechanism in a switching lever extracted state according to the second embodiment.

Once the switching lever 41 is further extracted in the switching lever extracting direction D2 from the state shown in FIG. 17, and enters the switching lever extracted state shown in FIG. 18, the switching lever 41 is in the most forward position by design, and the switching lever protruding part 72 is positioned below the top cover opening lever tip rotational trajectory RT, that is, outside the range where the top cover opening lever 36 moves. Therefore, the switching lever 41 is sheltered from the top cover opening lever tip rotational trajectory RT, and does not contact the top cover opening lever 36 that rotates in the top cover opening lever unlocking direction D1. Thereby, the top cover opening lever 36 can rotate in the top cover opening lever unlocking direction D1 without being obstructed (that is, without being physically interfered with) by the switching lever 41, and enters the unlocked posture P2.

Therefore, after entering the switching lever extracted state, that is, the shutter closed state (a state where the toner supply ports 29 are securely blocked with the duct shutters 30), the image forming apparatus 1 can allow the user to pull the top cover opening lever 36 toward the near side so that it rotates in the top cover opening lever unlocking direction D1 and open the top cover 6.

Thereby, once the top cover 6 and the basket frame 52 disengage, entering a second cover open mode mentioned above (FIG. 6), the image forming apparatus 1 can enter a state where the toner supply ports 29 are securely blocked with the duct shutters 30, and can prevent toners from leaking out from the toner supply ports 29 of the toner carrying ducts 28 that came off the development units 26.

In this manner, only when the switching lever 41 is in the switching lever pushed-in state or the switching lever extracted state, the image forming apparatus 1 prevents the switching lever protruding part 72 from obstructing the rotation of the top cover opening lever 36, and allows the top cover opening lever 36 to rotate in the top cover opening lever unlocking direction D1 from the locked posture P1 toward the unlocked posture P2 and open the top cover 6. On the other hand, when the switching lever 41 is in the switching lever extracting state, the image forming apparatus 1 allows the switching lever protruding part 72 to obstruct the rotation of the top cover opening lever 36, and prevent the top cover opening lever 36 from rotating in the top cover opening lever locking direction D1 and opening the top cover 6.

Therefore, in a state transitioning from the shutter open state to the shutter closed state, that is, in a midway state where the duct shutters 30 have not securely closed the toner supply ports 29, the image forming apparatus 1 can prevent the user from rotating the top cover opening lever 36 in the top cover opening lever unlocking direction D1 and opening the top cover 6.

Thereby, the image forming apparatus 1 can allow the user to understand its operation more easily and also prevent operation mistakes, therefore can prevent the user from mistakenly rotating the top cover opening lever 36 in the top cover opening lever unlocking direction D1 in a state where the duct shutters 30 have not securely closed the toner supply ports 29, resulting in the top cover 6 opening and toners leaking.

Other than the above, the image forming apparatus 101 by the second embodiment has almost the same actions and effects as the image forming apparatus 1 by the first embodiment.

3. Other Embodiments

Figure 19:
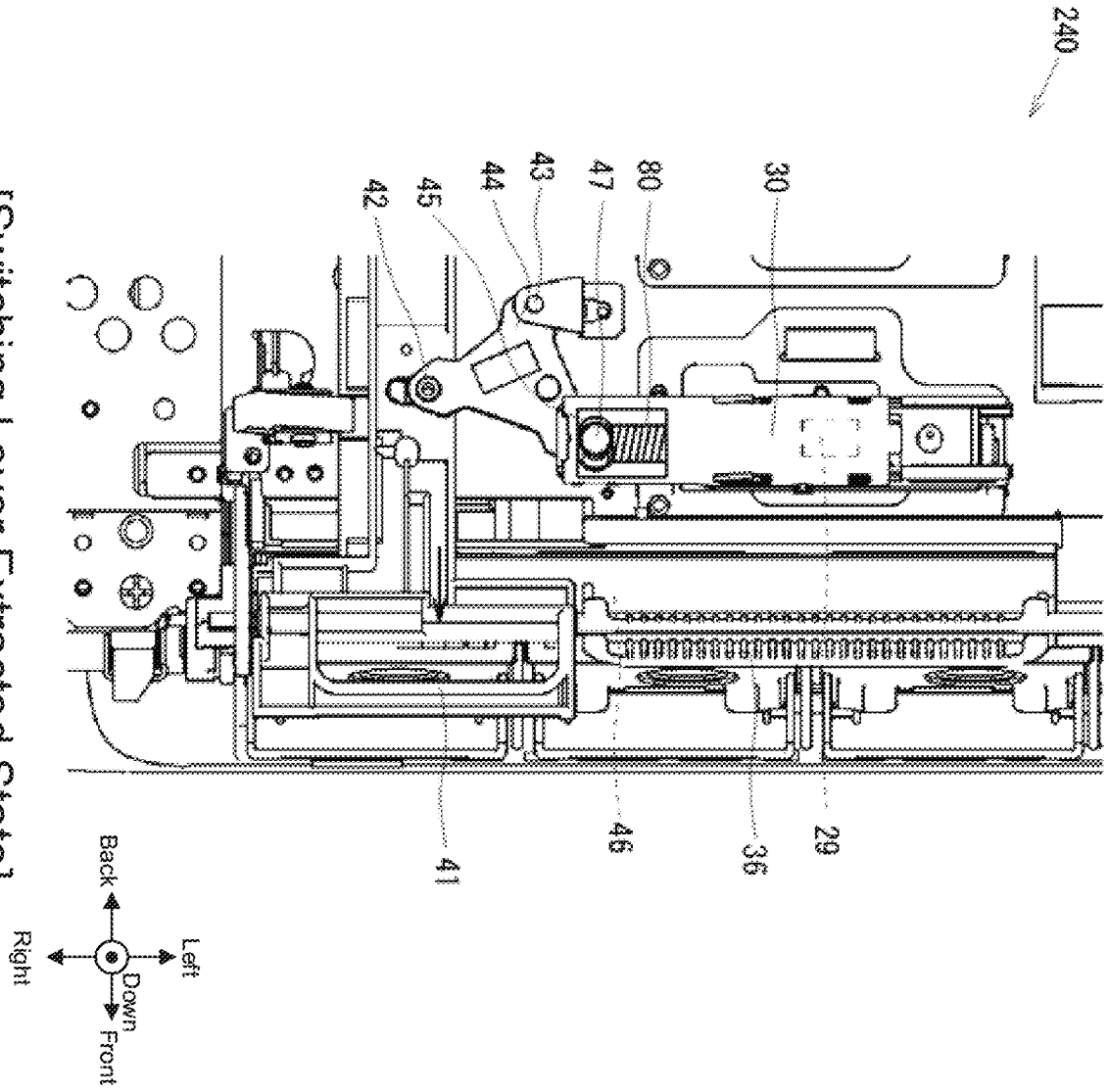
FIG. 19 is a bottom view showing the configuration of a shutter link part in a switching lever extracted state according to another embodiment.

Note that this invention is not limited to the shutter link part 40 (FIG. 12) by the first embodiment mentioned above, but can adopt a shutter link part 240 shown in FIG. 19 where the same codes are given to members corresponding to those in FIG. 12. The shutter link part 240 has a spring 80 added between a duct shutter 30 and a link lever 44. In this case, the link lever 44 pushes the duct shutter 30 in a shutter closing direction while crushing the spring 80. Thereby, compared with the shutter link part 40, the shutter link part 240 can reduce rattle while the link lever 44 pushes the duct shutter 30, and can securely close the duct shutter 30. The same applies to the second embodiment.

Also, explained in the above-mentioned second embodiment was a case where the top cover opening lever 36 rotates moving on an arc-shaped track, and the switching lever 41 moves along a linear direction. This invention is not limited to this, but the top cover opening lever 36 can move along a linear direction, and the switching lever 41 can rotate moving on an arc-shaped track. Also, the top cover opening lever 36 and the switching lever 41 can move along various other movement paths. The important point is that the top cover opening lever 36 and the switching lever 41 move along different tracks, and that the top over opening lever 36 movement path and the switching lever 41 movement path overlap at least partially in the switching lever extracting state, thereby allowing the switching lever 41 to restrict the movement of the top cover opening lever 36 in the switching lever extracting state.

Furthermore, explained in the above-mentioned embodiments was a case where the top cover 6 is rotated in the top cover opening direction in advance when the basket 54 (development units 26) is extracted to the outside of the chassis 2. This invention is not limited to this, but can adopt a configuration where the basket 54 (development units 26) is extracted to the outside of the chassis 2 while remaining in the top cover closed state without rotating the top cover 6 in the top cover opening direction.

Furthermore, in the above-mentioned embodiments, once the switching lever 41 is extracted toward the near side, after blocking the toner supply ports 29 with the duct shutters 30, the image forming unit 17 becomes detachable from the toner carrying ducts 28. This invention is not limited to this, but can move the duct shutters 30 by various other methods and block the toner supply ports 29 with the duct shutters 30 so that the image forming unit 17 becomes detachable from the toner carrying ducts 28.

Furthermore, explained in the above-mentioned embodiments was a case where this invention was applied to the tandem-system image forming apparatuses 1 and 101 having the individual color development units 26 arranged in series along the front-back direction. This invention is not limited to these but can be applied to color printers of other various systems such as the 4-cycle system.

Furthermore, explained in the above-mentioned embodiments was a case where this invention was applied to the image forming apparatuses 1 and 101. This invention is not limited to these but can be applied to other apparatuses such as facsimile machines, MFPs (MultiFunction Printers), and copiers.

Furthermore, this invention is not limited to the embodiments or the other embodiments mentioned above. That is, the scope of application of this invention includes embodiments that arbitrarily combine part or the whole of the above-mentioned embodiments and the above-mentioned other embodiments, and embodiments that extract part of them.

Furthermore, explained in the above-mentioned first embodiment was a case of composing the image forming apparatus 1 as an image forming apparatus of the image forming unit 17 as an image forming unit, the developer accommodation part 27 as a developer accommodation part, the duct shutters 30 as shutter members, and the switching lever 41 as a first operation part. This invention is not limited to this, but the image forming apparatus can be composed of an image forming unit, a developer accommodation part, shutter members, and a first operation part of other various configurations.

The first operation part functions to disengage (or release) the engagement between the image forming unit and the apparatus main body only when the shutter member(s) exists at the closed position (or shutter closed state), allowing the image forming unit to separate from the apparatus main body. When the shutter member(s) exists at the open position (or shutter open state), the first operation part functions to maintain the engagement so that the image forming unit is not allowed to separate (or detach) from the apparatus main body.

This invention can be utilized by an electrophotographic printer for example.

What is claimed is:

1. An image forming apparatus, comprising:

an apparatus main body including an image forming unit that forms an image on a medium and a cover member, the image forming unit and the cover member being independently rotatably attached to the apparatus main body, the cover member including:

a developer accommodation part that supplies a developer to the image forming unit, a developer supply duct that is disposed between the image forming unit and the developer accommodation part such that the developer reaches the image forming unit through the developer supply duct, a shutter member that reciprocates between an open position and a closed position wherein the developer is provided to the image forming unit through the shutter member when the shutter member is at the open position, and the developer is blocked with the shutter member when the shutter member is at the closed position, a first operation part that comprises an engaging part, which engages with the image forming unit, and moves the shutter member either to the open position or to the closed position, wherein the first operation part causes the engaging part to disengage from the image forming unit when the shutter member exists at the closed position, in a disengaged state in which the engaging part is disengaged from the image forming unit, the cover member rotates relative to the apparatus main body and independently from the image forming unit.

2. The image forming apparatus according to claim 1, wherein the first operation part moves the shutter member toward a position where the engaging part disengages an engagement with the image forming unit, the shutter member moves from the open position toward the closed position as being linked with the first operation part, and the engaging part moves to the position where the engaging part disengages the engagement after the shutter member moves from the open position toward the closed position, and reaches the closed position.

3. The image forming apparatus according to claim 2, wherein the shutter member moves in a shutter closing direction, and after reaching the closed position, the shutter member maintains a developer supply blockage state to block the developer supply duct even after the image forming unit and the engaging part disengage.

4. The image forming apparatus according to claim 2, wherein the shutter member moves in a shutter closing direction, and after reaching the closed position, the shutter member does not move in the shutter closing direction by a force by which the first operation part is moved, and maintains a developer supply blockage state to block the developer supply duct even after the image forming unit and the engaging part disengage.

5. The image forming apparatus according to claim 1, wherein the first operation part moves in a front-back direction with respect to the image forming apparatus, and the shutter member moves in a different direction from the front-back direction.

6. The image forming apparatus according to claim 1, further comprising:

the cover member covers one side of the apparatus main body, and the image forming unit is rotatable with respect to the apparatus main body together with the cover member in an engaged state in which the engaging part is engaged with the image forming unit.

7. The image forming apparatus according to claim 1, wherein the cover member rotates around a rotation shaft, the image forming unit is installed on the rotation shaft such that the cover member and image forming unit coaxially rotates, and the engaging part and the rotation shaft are disposed sandwiching the image forming unit.

8. The image forming apparatus according to claim 1, wherein the image forming unit comprises a development unit that forms an image on the medium, and a holding unit that holds the development unit, and the engaging part engages with the holding unit of the image forming unit.

9. The image forming apparatus according to claim 1, further comprising:

a second operation part that opens or closes the cover member, wherein the first operation part is in contact with the second operation part while the engaging part is in a transition state that is defined as being positioned from a position engaged with the image forming unit to a position disengaged from the image forming unit.

10. The image forming apparatus according to claim 9, wherein the second operation part moves rotating along a prescribed rotational trajectory, and the first operation part moves linearly in a front-back direction, and enters the rotational trajectory in the transition state, restricting the movement of the second operation part.

11. An image forming apparatus, comprising:

an image forming unit that forms an image on a medium, a developer accommodation part that supplies a developer to the image forming unit, a developer supply duct that is disposed between the image forming unit and the developer accommodation part such that the developer reaches the image forming unit through the developer supply duct, a shutter member that reciprocates between an open position and a closed position wherein the developer is allowed to pass through the shutter member when the shutter member is at the open position, and the developer is blocked with the shutter member when the shutter member is at the closed position, a first operation part that comprises an engaging part, which engages with the image forming unit, and moves the shutter member either to the open position or to the closed position, wherein the first operation part causes the engaging part to disengage from the image forming unit when the shutter member exists at the closed position, and the first operation part moves in a front-back direction with respect to the image forming apparatus, and the shutter member moves in a different direction from the front-back direction.

* * * * *